US009659424B2

(12) United States Patent
Huber et al.

(10) Patent No.: US 9,659,424 B2
(45) Date of Patent: May 23, 2017

(54) TECHNOLOGIES AND METHODS FOR SECURITY ACCESS

(71) Applicant: PARAKEET TECHNOLOGIES, INC., Provo, UT (US)

(72) Inventors: Braden R. Huber, Orem, UT (US); Wayne K. Maughan, Draper, UT (US)

(73) Assignee: PARAKEET TECHNOLOGIES, INC., Provo, UT (US)

( * ) Notice: Subject to any disclaimer, the term of this patent is extended or adjusted under 35 U.S.C. 154(b) by 109 days.

(21) Appl. No.: 14/310,672

(22) Filed: Jun. 20, 2014

(65) Prior Publication Data

US 2014/0375422 A1 Dec. 25, 2014

Related U.S. Application Data

(60) Provisional application No. 61/837,487, filed on Jun. 20, 2013.

(51) Int. Cl.
*G07C 9/00* (2006.01)

(52) U.S. Cl.
CPC ..... *G07C 9/00571* (2013.01); *G07C 9/00174* (2013.01); *G07C 9/0069* (2013.01); *G07C 2209/08* (2013.01)

(58) Field of Classification Search
CPC ..... G07C 9/00174; G07C 9/00698; G07C 9/00134; G07C 2209/14; G07C 9/00571; G07C 9/0069; G07C 2209/08
See application file for complete search history.

(56) References Cited

U.S. PATENT DOCUMENTS 5,272,318 A * 12/1993 Gorman ..... G06K 17/00 235/375
5,283,431 A * 2/1994 Rhine ..... B60R 25/04 235/382

(Continued)

OTHER PUBLICATIONS

"7 Ways QR Codes Can Be Used on Your Real Estate Marketing Products_Contra Costa Association of REALTORS®". [Online] 2011. http://www.ccartoday.com/news/7-ways-qr-codes-can-be-used-your-real-estate-marketing-products (accessed Nov. 9, 2012).

(Continued)

*Primary Examiner* — Brian Miller
(74) *Attorney, Agent, or Firm* — Workman Nydegger

(57) ABSTRACT

Embodiments herein are directed security access. Embodiments include an electronic lock that executes a time-based cryptographic algorithm to compute a time-based access code. The electronic lock compares the time-based access code with a received access code, and grants access to one or more lock features when the time-based access code matches the received access code. Embodiments also include providing an unlock code, including receiving a lock identifier and a user identifier. The lock identifier and the user identifier are sent to a remote computer system, and an access code for the lock is received from the remote computer system. Embodiments also include an electronic lock that receives and verifies an access code that includes a validity start time and a validity end time. When the current time is within the validity start time and the validity end time, the electronic lock grants access to one or more lock features.

20 Claims, 23 Drawing Sheets

(56) References Cited

U.S. PATENT DOCUMENTS 6,472,973 B1 10/2002 Harold et al.
6,769,611 B2 * 8/2004 Miller ..... G07F 17/12 235/375
6,989,732 B2 1/2006 Fisher
7,009,489 B2 3/2006 Fisher
7,420,456 B2 9/2008 Fisher
8,672,221 B2 * 3/2014 Kobres ..... B64F 1/366 235/375
8,775,209 B2 * 7/2014 Auchinleck ..... G06Q 50/22 705/3
8,881,252 B2 * 11/2014 Van Till ..... H04L 63/08 726/19
8,918,898 B2 * 12/2014 Nielsen ..... G08B 5/22 726/27
8,947,200 B2 * 2/2015 Kuenzi ..... G07C 9/00103 340/5.51
9,077,714 B2 * 7/2015 Neuman ..... H04L 63/08
9,165,421 B2 * 10/2015 Lyons ..... G07F 17/3211
9,396,043 B2 * 7/2016 Yip ..... G06F 9/52
2004/0025039 A1 2/2004 Kuenzi et al.
2008/0195251 A1 * 8/2008 Milner ..... B67D 3/0035 700/237
2009/0101711 A1 * 4/2009 Grayson ..... A47G 29/141 235/382.5
2009/0324025 A1 * 12/2009 Camp, Jr. ..... G07C 9/00007 382/124
2010/0176146 A1 * 7/2010 Ben-Dor ..... A61J 1/1437 221/97
2010/0176919 A1 7/2010 Myers et al.
2010/0250937 A1 9/2010 Blomquist et al.
2011/0130134 A1 6/2011 Van Rysselberghe
2012/0068817 A1 3/2012 Fisher
2012/0119877 A1 5/2012 Ng et al.
2013/0254897 A1 * 9/2013 Reedy ..... G06F 21/10 726/26
2013/0257590 A1 * 10/2013 Kuenzi ..... G05B 1/01 340/5.65
2013/0307670 A1 * 11/2013 Ramaci ..... G06F 21/6245 340/5.82
2013/0325706 A1 * 12/2013 Wilson ..... G06Q 20/042 705/40
2014/0068247 A1 * 3/2014 Davis ..... B60R 25/24 713/155
2014/0344082 A1 * 11/2014 Soundararajan ..... G06Q 20/40 705/16
2014/0375422 A1 * 12/2014 Huber ..... G07C 9/00174 340/5.61
2015/0007619 A1 * 1/2015 Finney ..... B62J 11/00 70/58
2015/0039357 A1 * 2/2015 Segal ..... G06Q 10/06314 705/5
2015/0237031 A1 * 8/2015 Neuman ..... H04L 63/08 713/176
2015/0371470 A1 * 12/2015 Brown ..... G07C 9/00896 340/5.61
2016/0042415 A1 * 2/2016 Min ..... G06Q 30/0611 705/26.4

OTHER PUBLICATIONS

Kidd. "How to open a Supra Lockbox . . . with your iPhone 5_RealtyTechBytes". [Online] 2012. http://realtytechbytes.com/how-to-open-a-supra-lockbox-with-your-iphone-5 (accessed Nov. 9, 2012).

* cited by examiner

TECHNOLOGIES AND METHODS FOR SECURITY ACCESS

CROSS-REFERENCE TO RELATED APPLICATION

This application claims priority to, and the benefit of, U.S. Provisional Application No. 61/837,487, which was filed Jun. 20, 2013, and which is entitled "TECHNOLOGIES AND METHODS FOR SECURITY ACCESS." The entire content of the foregoing provisional application is expressly incorporated by reference herein in its entirety.

BACKGROUND

1. Field of the Invention

The present invention relates to mechanical and/or electronic locks that include machine-readable optical (visual) lock identifiers, and to the dissemination of access codes for the mechanical and/or electronic locks based on the machine-readable optical lock identifiers.

2. Background and Relevant Art

Many fields benefit from the use of locks and/or lockboxes that are available for use by a potentially undefined or unknown number of individuals. For example, in the field of real estate, lockboxes are commonly employed to provide a large number of real estate agents access to a listed property. Such lockboxes typically secure to the property (e.g., to the door), and provide authorized agents secured access to a compartment that contains mechanisms (e.g., keys, electronic access cards) etc. for accessing the property. Such lockboxes may employ static access codes. However, use of static access codes can present a significant security risk, since an unauthorized person may gain knowledge of the access code, access is not tracked, or a person who was once authorized to access the lockbox loses such authorization while retaining the access code.

Some lockboxes are configured to be unlocked using specialized interface hardware that is issued to individuals who are authorized to access the lockboxes. However, use of specialized interface hardware increases the administrative cost (both in terms of financial resources and human time) of using lockboxes. Perhaps most importantly, use of specialized hardware constrains the types of users who can use the locks and/or lockboxes, and prevents use by impromptu users. For example, specialized interface hardware (e.g., in real estate) may make it impossible for users (e.g., assessors, appraisers, various contractors, buyers, etc.) to access locks, given that mass distribution of the specialized interface hardware is impractical.

In another example, combination locks may be used to secure any number of resources, such as gates, storage units, equipment, etc. Such combination locks typically employ static access codes which, as described above, can present a significant security risk since an unauthorized person may gain knowledge of the access code, or a person who was once authorized to access the combination lock loses that authorization but retains the access code.

Accordingly, there remains room for improvement in the field of locks and lockboxes, and for managing access to locks and lockboxes.

BRIEF SUMMARY

At least some embodiments described herein are directed to electronic lockboxes that provide access to lock features based on a received access code. At least some embodiments described herein are also directed to receiving an access code for an electronic lockbox. For example, an embodiment may include a mobile computer system for providing an unlock code for a lock. The embodiment includes the mobile computer system receiving a lock identifier for a lock and receiving a user identifier identifying a user of the mobile computer system. The embodiment also includes sending the lock identifier and the user identifier to a remote computer system and, based on sending the lock identifier and the user identifier to the remote computer system, receiving an access code for the lock.

An embodiment of an electronic lock may include one or more processors that are configured to execute a time-based cryptographic algorithm to compute a time-based access code, and to compare the time-based access code with a received access code. The one or more processors may also be configured to grant access to one or more lock features when the time-based access code matches the received access code. The electronic lock may also include a machine-readable optical identifier that encodes at least a lock identifier of the electronic lock, and an input device that is configured to receive an access code and communicate the access code to the one or more processors.

Another embodiment of an electronic lock may include one or more processors that are configured to receive an access code that includes a validity start time and a validity end time, and to verify authenticity of the received access code. The one or more processors may also be configured to determine if a current time is within the validity start time and the validity end time, and grant access to one or more lock feature when the current time is within the validity start time and the validity end time. The electronic lock may also include an input device configured to receive the access code and communicate the access code to the one or more processors.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
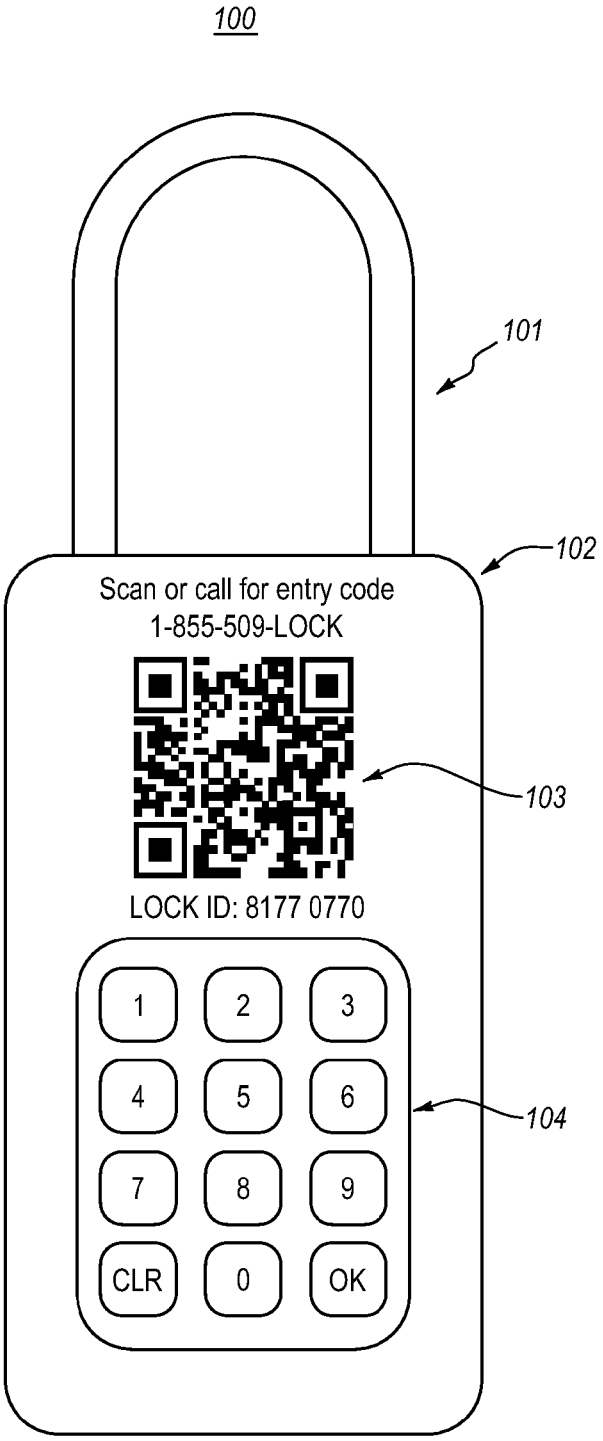
FIG. 1 illustrates an electronic lock, according to one or more embodiments.

Embodiments described herein relate to methods, apparatus, systems, and computer program products relating to providing access to locking mechanisms through use of machine-readable optical (visual) identifiers that are attached to or embedded on the locking mechanisms. Embodiments include electronic and mechanical locks that include machine-readable optical identifiers, machine-readable optical identifiers that are configured to be affixed to locks (e.g., stickers or adhesives), and computer systems for use with machine-readable optical identifiers.

The embodiments described herein offer improvements over prior locking solutions, by enabling lock managers to automatically distribute access codes for locks upon user request, with the access codes potentially being valid for limited periods of time. Further, since the embodiments described herein enable lock managers to automatically distribute access codes that are valid for limited times upon demand, lock managers are enabled to perform granular lock management, such as denying lock access during certain time periods, denying lock access to a user that has become unauthorized, performing granular logging, etc.

At least some embodiments described herein relate to electronic locks that communicate a lock identifier in a static or dynamic machine-readable optical form. At least some embodiments described herein also relate to electronic locks that include computer hardware and software/firmware for computing time-based access codes, for receiving access codes from a user or a user device, and for validating the received access codes against the computed access codes. In some embodiments, for example, an electronic lock includes computer hardware and software/firmware that executes a time-based cryptographic algorithm to generate different access codes that are valid during different periods of time (e.g., periods lasting for a number of seconds, minutes, hours, or days). The electronic locks according to these embodiments can then be used in connection with computing devices and/or computing systems, which execute the same or a complimentary time-based cryptographic algorithm to generate the same access codes as the electronic lock during the same period, and which are useable for unlocking/accessing the electronic lock during the period. The lock identifier of the electronic lock may be communicated visually/optically to the computing devices and/or computing systems, and can be used during generation of the access codes and/or for validation of a person attempting to access the electronic lock.

In addition, at least some embodiments described herein relate to mechanical locks that include machine-readable optical identifiers identifying the locks. In some embodiments, for example, a mechanical lock includes a static access code and a machine-readable optical identifier that includes at least a lock identifier. Based on visually/optically reading the lock identifier, a computing device and/or computing system can provide the static access code to a user, thereby granting access to the mechanical lock. In other embodiments, a mechanical lock includes a rotating and/or deterministically changing access code, and a machine-readable optical identifier that includes at least a lock identifier. Based on visually/optically reading the lock identifier, and based on past knowledge of access to the mechanical lock, a computing device and/or a computing system can provide a user a current access code to grant access to the mechanical lock.

At least some embodiments described herein also relate to machine-readable optical identifiers that are configured to be affixed to locks, such as stickers containing a machine-readable optical tag. The machine-readable optical tag encodes at least a machine-readable lock identifier that can be used by a computing device and/or a computing system to provide a user an access code to the lock to which the sticker is affixed.

Embodiments described herein also include methods, systems, computer program products, and user interfaces related to use of the electronic locks, mechanical locks, and stickers that are described herein. For example, embodiments include functionality performed by electronic locks, functionality performed by a mobile computing device, such as a smartphone, functionality performed by a server computer system, and user interfaces for managing locks and lock users.

Embodiments of the present invention may comprise or utilize a special-purpose or general-purpose computer system that includes computer hardware, such as, for example, one or more processors and system memory, as discussed in greater detail below. Embodiments within the scope of the present invention also include physical and other computer-readable media for carrying or storing computer-executable instructions and/or data structures. Such computer-readable media can be any available media that can be accessed by a general-purpose or special-purpose computer system. Computer-readable media that store computer-executable instructions and/or data structures are computer storage media. Computer-readable media that carry computer-executable instructions and/or data structures are transmission media. Thus, by way of example, and not limitation, embodiments of the invention can comprise at least two distinctly different kinds of computer-readable media: computer storage media and transmission media.

Computer storage media are physical storage media that store computer-executable instructions and/or data structures. Physical storage media includes recordable-type storage devices, such as RAM, ROM, EEPROM, solid state drives ("SSDs"), flash memory, phase-change memory ("PCM"), optical disk storage, magnetic disk storage or other magnetic storage devices, or any other physical storage medium which can be used to store program code in the form of computer-executable instructions or data structures, and which can be accessed by a general-purpose or special-purpose computer system.

Transmission media can include a network and/or data links which can be used to carry program code in the form of computer-executable instructions or data structures, and which can be accessed by a general-purpose or special-purpose computer system. A "network" is defined as one or more data links that enable the transport of electronic data between computer systems and/or modules and/or other electronic devices. When information is transferred or provided over a network or another communications connection (either hardwired, wireless, or a combination of hardwired or wireless) to a computer system, the computer system may view the connection as transmission media. Combinations of the above should also be included within the scope of computer-readable media.

Further, upon reaching various computer system components, program code in the form of computer-executable instructions or data structures can be transferred automatically from transmission media to computer storage media (or vice versa). For example, computer-executable instructions or data structures received over a network or data link can be buffered in RAM within a network interface module (e.g., a "NIC"), and then eventually transferred to computer system RAM and/or to less volatile computer storage media at a computer system. Thus, it should be understood that computer storage media can be included in computer system components that also (or even primarily) utilize transmission media.

Computer-executable instructions comprise, for example, instructions and data which, when executed at one or more processors, cause a general-purpose computer system, special-purpose computer system, or special-purpose processing device to perform a certain function or group of functions. Computer-executable instructions may be, for example, binaries, intermediate format instructions such as assembly language, or even source code.

Those skilled in the art will appreciate that the invention may be practiced in network computing environments with many types of computer system configurations, including, personal computers, desktop computers, laptop computers, message processors, hand-held devices, multi-processor systems, microprocessor-based or programmable consumer electronics, network PCs, minicomputers, mainframe computers, mobile telephones, PDAs, tablets, pagers, routers, switches, and the like. The invention may also be practiced in distributed system environments where local and remote computer systems, which are linked (either by hardwired data links, wireless data links, or by a combination of hardwired and wireless data links) through a network, both perform tasks. As such, in a distributed system environment, a computer system may include a plurality of constituent computer systems. In a distributed system environment, program modules may be located in both local and remote memory storage devices.

Electronic Lock

FIG. 1 illustrates an electronic lock 100, according to one or more embodiments of the invention. In the depicted embodiment, the electronic lock 100 takes the form of a lockbox, similar to the lockboxes presently used in the real estate industry, having a shackle 101 for securing the lock to a stationary object (e.g., a door, a gate, gasline piping, etc.) and a lockable compartment (not shown) within a housing 102 for securing items (e.g., keys, key fobs, access cards, garage door openers, etc.). Despite the electronic lock 100 being depicted as a lockbox, the principles described in connection with the electronic lock 100 are applicable to virtually any type of lock. As such, the disclosure herein should not be construed as being limited to real estate lockboxes.

The electronic lock 100 includes and employs computer circuitry and software/firmware to execute a time-based algorithm that generates access codes that are valid for limited periods of time. The computer circuitry and software/firmware are also configured to receive user input comprising an access code. Such user input can be received at any appropriate input device, such as the depicted keypad 104. The computer circuitry and software/firmware are also configured to compare a received access code to the current access code that has been generated by the time-based algorithm at the electronic lock 100, and to grant or deny a user access to certain functionality of the electronic lock 100 based on whether the received access code matches the generated access code. Granting or denying access to functionality of the electronic lock 100 may include providing access to the lockable compartment, unlocking the shackle 101, enabling configuration capabilities, providing access to lock logs, etc.

To facilitate a user gaining knowledge of the access code that has been (or would be) generated by the electronic lock 100 for the current period, the electronic lock 100 includes a machine-readable optical identifier 103 (i.e., the depicted Quick Response Code (QR Code)). The machine-readable optical identifier 103 encodes at least a lock identifier that provides the identity the electronic lock 100 as it is registered in a lock management system. The machine-readable optical identifier 103 enables the user to optically obtain the lock identifier using a camera or other optical sensing device of a properly configured electronic device (e.g., a smartphone having appropriate software installed and running thereon, a desktop or laptop computer, wearable electronics such as watches or glasses, etc.). After doing so, the portable electronic device may provide the user with the access code that is valid during the current period at the electronic lock 100.

The access code that is provided by the portable electronic device may be computed by the portable electronic device itself based on the lock identifier, or may be received by the portable electronic device from another device (e.g., a server) after providing the lock identifier to the other device. For example, the access code for the current period may be computed with a time-based algorithm that is the same as or complimentary to the time-based algorithm that is executed at the electronic lock 100, and that is executed by the portable electronic device and/or by the other device.

To the accomplishment of the foregoing, the electronic lock 100 may include various electronic components and one or more batteries configured to provide power to the electronic components. In some embodiments, for example, the electronic components include one or more processors/microcontrollers, a real time clock (RTC), and a user input device, such as the depicted keypad 104. Other electronic components may include one or more transducers, persistent memory, one or more external electronic interfaces, one or more battery status displays, external illumination/lighting, one or more dynamic displays (e.g., a LCD display, an electronic ink display, etc.), one or more solar cells, one or more radios (e.g., WiFi, NFC, Bluetooth, RFID), one or more infrared transmitters/receivers, one or more lights or light emitting diodes (LEDs), one or more cameras or light-sensing devices, one or more microphones, one or more speakers or buzzers, etc.

The RTC is an electronic clock circuit that is configured to keep an accurate accounting of time. In some embodiments, the RTC is temperature-compensated and accurate to the order of single-digit minutes of clock drift per year. Thus, the RTC can provide an accounting of time that stays in relatively accurate synchronization with other devices over a period of several years. The RTC is configured to provide a representation of the current time (e.g., a count of a number of clock cycles, a count of time units such as milliseconds or seconds, time since UNIX epoch, a date/time format, or any other appropriate time representation) to another component, such as the microcontroller(s).

Based on time data provided by the RTC, the microcontroller(s) are configured to generate access codes using a time-based cryptographic algorithm. In some embodiments, the microcontroller(s) are low-power consumption microcontroller(s), such as those using the AVR architecture from Atmel of San Jose, Calif., although other processor architectures (e.g., PIC, ARM, etc.) may be used. The time-based cryptographic algorithm executed by the microcontroller(s) produces the same access code for the duration of a particular period, such as for a period of one minute, a period of ten minutes, for a period of thirty minutes, for a period of one hour, for a period of one day, etc. The cryptographic algorithm can comprise any appropriate time-based cryptographic algorithm that produces the same result for a given period, such as a time-based one-time password algorithm (TOTP), a keyed-hash message authentication code (HMAC)-based one-time password algorithm (HOTP), etc.

The keypad 104 can comprise any appropriate keypad that receives user input and that sends the user input electronically to the microprocessor(s). For example, the keypad 104 may comprise physically actuated buttons, touch-sensitive (e.g., capacitive, resistive) buttons, etc. Although the keypad 104 is depicted as a numeric keypad, the keypad 104 may comprise any input type, including alphabetic characters, numbers, symbols (e.g., Up, Down, Left, Right), function-based buttons, etc. The keypad 104 may provide one or more of tactile, haptic, audible, or visual feedback during use.

The machine-readable optical identifier 103 can comprise any form of optical data that can be readily interpreted by a computer system. For example, the machine-readable optical identifier 103 may comprise a matrix or two-dimensional barcode (e.g., QR Code, Microsoft Tag, Data Matrix, MaxiCode, etc.), a linear or one-dimensional barcode, plain text, shapes, colors, etc.

Generally, the machine-readable optical identifier 103 includes or encodes at least an identifier of the electronic lock 100, but may include/encode additional information as well. Different data fields of a QR code, for example, can be used to store different types of information. For example, in addition to a lock identification field, the machine-readable optical identifier 103 may also include one or more Uniform Resource Locator (URL) fields that direct a scanning device to a web page that provides information about gaining access to the electronic lock 100, one or more URL fields that direct a scanning device to a web page that provides for account registration, one or more URL fields that direct a scanning device to a download location for software (e.g., an smartphone "app") for use with machine-readable optical identifier 103, etc. Other fields are also possible, as described later.

As mentioned previously, the electronic lock 100 can include additional electronic components, such as one or more transducers. The transducer(s) can be usable for opening and closing the shackle 101 and/or the lockable compartment via an electronic signal from the microcontroller(s). The transducer(s) can also be usable for detecting the closing of the shackle 101 and/or the lockable compartment by a user, and for communicating this information to the microcontroller(s). As discussed later, the transducer(s) may also be usable for providing a battery status display.

The electronic lock 100 can include non-volatile or persistent memory (e.g., ROM, EEPROM, NVRAM, etc.). The persistent memory can be usable for storing log information, such as log information regarding user interaction with the electronic lock 100 (e.g., successful and failed access attempts), shackle-release, shackle-close, lockbox open, lockbox close, etc. In some embodiments, the persistent memory stores log information over the life of the electronic lock 100, though the persistent memory may store only a subset of log information (e.g., logs over a most recent time period, logs since a last log download, etc.).

With reference to logs, the electronic lock 100 may use a variety of techniques to version logs and synchronize log information with external copies. In some embodiments, for example, the electronic lock 100 may store logs as a plurality of individual log entries (e.g., one entry for each log event). As such, the electronic lock 100 can synchronize logs with external copies by the transfer of individual log entries. The electronic lock 100 may keep a count of the total number of log entries, which can then be used to identify how many entries should be transferred to an external copy of the log.

In additional or alternative embodiments, the electronic lock 100 may apply versions to the log information generally, and/or to individual log entries. A log version may identify a particular data format (e.g., data fields, data encodings, etc.) that is used by the log. As such, the data format of the log may change over time, and/or the data format may vary by log entry.

In additional or alternative embodiments, the electronic lock 100 may develop a hash (e.g., SHA1) over all or part of the log. The hash may be usable to identify a current state or "snapshot" of the log. The hash can be usable for identifying if the copy of the log at the electronic lock 100 is in sync with another copy (such as a copy at a server). For example, if a server's own hash of its copy of the log matches the hash generated by the electronic lock 100, then the server's log matches the lock's log.

In some embodiments, the electronic lock 100 may record a geo-location with log events. For example, the electronic lock 100 may include a GPS receiver, and use the GPS receiver to record the geo-location of different access events. In another example, the electronic lock 100 may receive geo-location information from a mobile device (e.g., from a GPS receiver at the mobile device), and use the received geo-location information to record the geo-location an access event that is associated with the mobile device. By recording geo-location information, the electronic lock 100 can help an administrator/owner/operator track various locks.

The persistent memory may also store one or more rules regarding access to the electronic lock 100, such as times that access to the electronic lock 100 should be permitted, and/or times that access to the electronic lock 100 should be denied. If such rules are present, the rules can be enforced by the microcontroller(s) when a user attempts to gain access to the electronic lock 100.

The electronic lock 100 can include one or more external electronic interfaces, such as one or more Universal Serial Bus (USB) ports. In some embodiments, the external electronic interface(s) is/are located within the lockable compartment to prevent unauthorized access to the external electronic interface(s) and to prevent exposure of the external electronic interface(s) to weather. The external electronic interface(s) may be usable to download log information from the persistent memory. For example, upon insertion of a USB mass storage device, the electronic lock 100 may be configured to automatically download all or a portion of the log information to the USB mass storage device. The external electronic interface(s) may be usable to charge the battery, to set/reset the RTC, to add/remove/modify rules, to reprogram/update/debug the software/firmware, etc. In some embodiments, log information that is downloaded to a USB mass storage device is stored on the USB mass storage device in an encrypted form.

Figure 2:
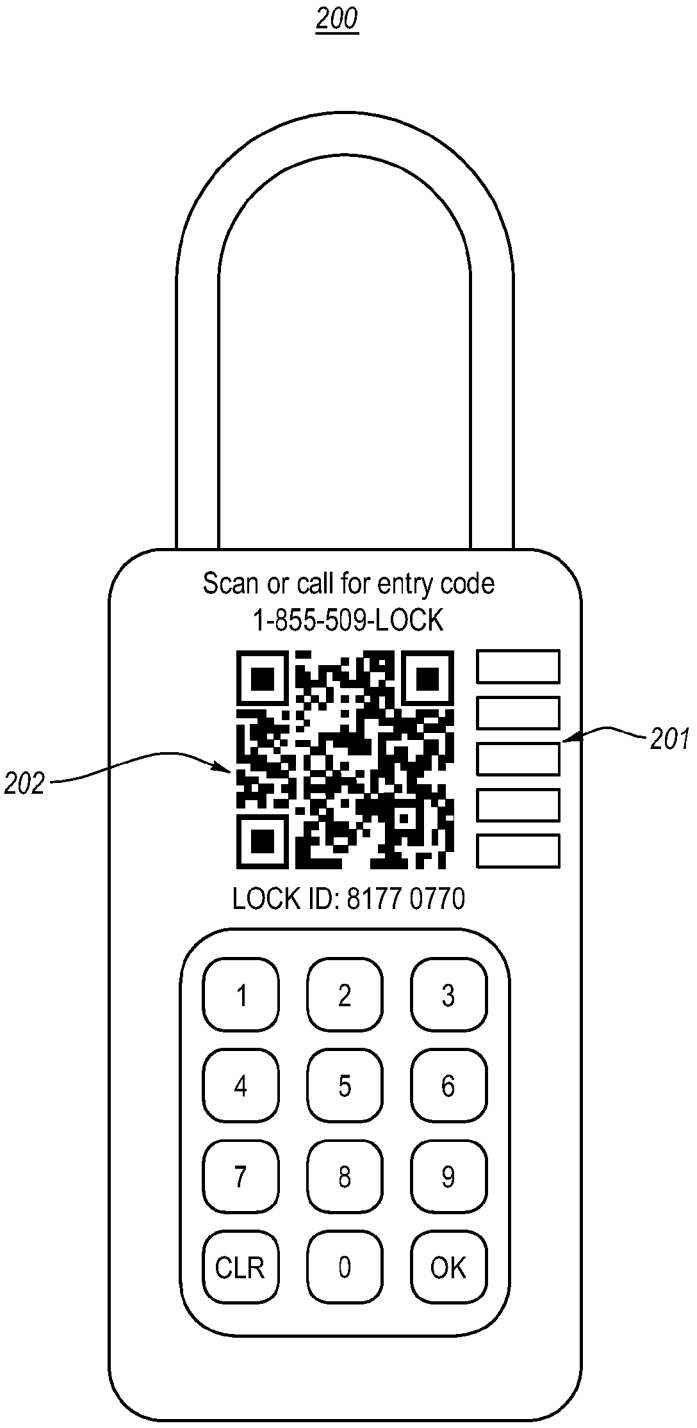
FIG. 2 illustrates an electronic lock, including a battery display, according to one or more embodiments.

The electronic lock 100 can include a battery status display. For example, FIG. 2 illustrates an alternative embodiment comprising an electronic lock 200 that includes a battery display 201. The battery display 201 may comprise one or more filament lights, one or more LEDs, one or more Liquid Crystal Displays (LCDs), electronic paper, cholesteric LCD, or any other appropriate battery status indication device. The transducers may drive the battery display 201.

In some embodiments, a battery status display is configured to be machine-readable. For example, the battery display 201 is depicted as being a "fuel gauge" comprising a plurality of LEDs positioned near a machine-readable optical identifier 202, and which can also be captured at the same time as machine-readable optical identifier 202 is scanned. As such, a computing device may be configured to ascertain battery level based on detection of the number of LEDs that are illuminated. In other embodiments, the battery level may be ascertained based on a light pulse rate, a light color, or any other visually distinguishable characteristic. As such, the battery display 201 may comprise a few as one light emission devices. In other embodiments, the battery level may be displayed using numbers and/or text.

In additional or alternative embodiments, battery status is communicated to a computer or a human through audible beeps/tones. In some embodiments, the beeps/tones are machine-discernable. In these embodiments, the beeps/tones may be emitted at a frequency not discernable by the human ear. In some embodiments, the beeps/tones are discernable by a human (e.g., one or more jingles that indicate when the battery is in a charged/good condition, or when the battery is in a depleted/bad condition).

Figure 3:
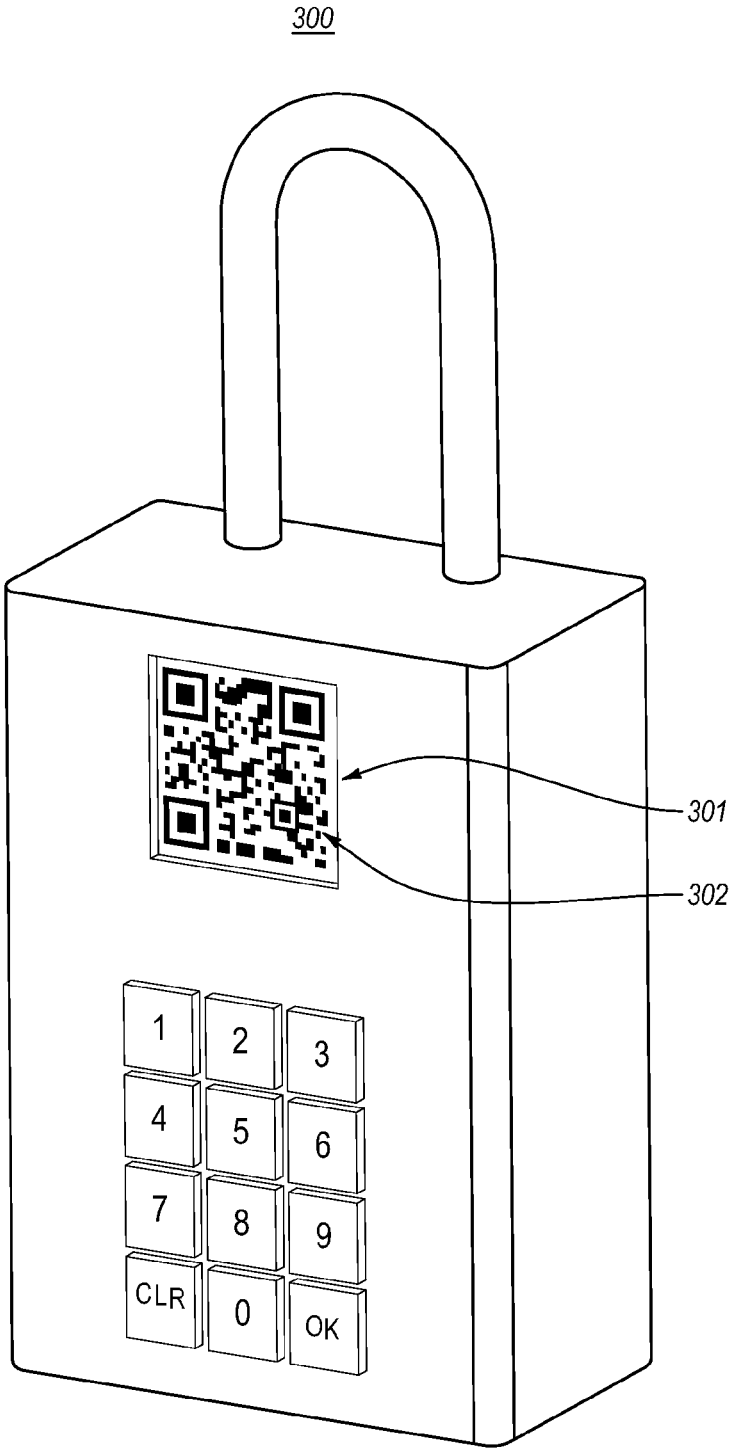
FIG. 3 illustrates an electronic lock, including a dynamic display, according to one or more embodiments.

The electronic lock 100 can include one or more dynamic displays, such as a LCD display, an electronic paper display, or a cholesteric LCD. FIG. 3 illustrates an embodiment of an electronic lock 300 that includes a dynamic display 301. The dynamic display 301 may display one or more of a machine-readable optical identifier 302, log information, battery level information, etc. In some embodiments, the machine-readable optical identifier 302 displayed on the dynamic display 301 includes a plurality of encoded fields, such as lockbox identifier, battery level, log information (e.g., log entries, log hash, log version), firmware information, clock information, etc. As such, the machine-readable optical identifier 302 becomes a dynamic identifier that is updated to communicate information to other computing devices. For example, the machine-readable optical identifier 302 may be dynamically-updated to reflect a changed battery level, to include one or more most recent log entries, to include an updated hash (e.g., SHA1) over the entire log or a portion of the log, to include a log version, to warn of repeated denied access attempts, etc.

Figure 4:
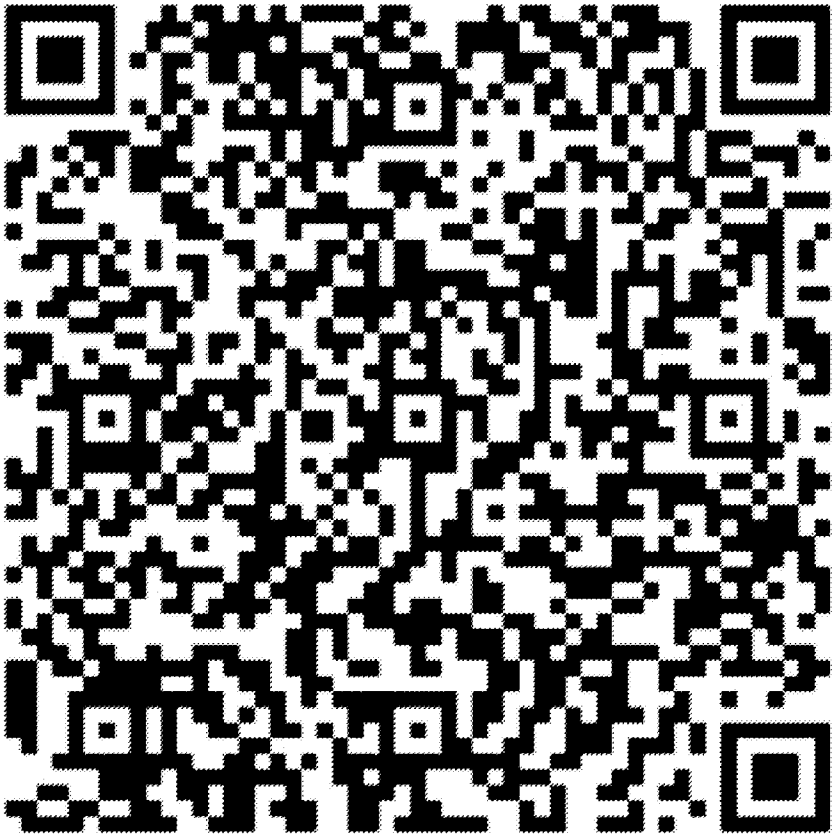
FIG. 4 illustrates a machine-readable optical identifier that encodes a plurality of data fields, according to one or more embodiments.

For example, FIG. 4 illustrates a QR code that encodes a plurality of data fields as a textual string. In this particular example, the QR code encodes the following textual string: 'www.qrlock.com BAT-90 LOCK-4A17D3852 LHASH-AE5B234AC1 CLK-A35F2D2 LVERS-A58BC32 FVERSION-C769031'. Decoded to a plain English form, this textual string represents the following: www.qrlock.com, battery level: 90%, lock identifier: 4A17D3852, log hash: AE5B234AC1, lock clock: A35F2D2, log version: A58BC32, firmware version: C769031. In view of the foregoing, one will appreciate that a QR code can include a great variety of data relating to locks that can be communicated optically. In some embodiments, a QR code could encode data fields in a binary form, potentially decreasing the visual size and/or complexity of the resulting QR code.

When the machine-readable optical identifier 302 includes log information, that information can be used to update/verify log information at a server. For example, if the machine-readable optical identifier 302 includes a most recent log entry, the server can compare the log entry from the machine-readable optical identifier 302 with its log information to identify whether the server has the most up-to-date logs. In another example, if the machine-readable optical identifier 302 includes a hash over the entire log, the server can perform the same hashing function over its log, and then compare the hash from the machine-readable optical identifier 302 with the hash generated by the server. If there is a log discrepancy, the logs from the electronic lock 100 can be obtained by a user using the external electronic interface(s) (e.g., USB flash drive).

The electronic lock 100 may, in some embodiments, include one or more wireless communications interfaces, such as one or more radios (e.g., Wireless-Fidelity (WiFi), Bluetooth (e.g., version two and/or version four including BLE (Bluetooth low energy)), Near-Field Communication (NFC), Radio-Frequency Identification (RFID)), and/or one or more infrared transmitters/receivers. In such embodiments, the wireless communications interface(s) may be used for software/firmware updates, downloading of logs, updating or rules, etc.

Wireless communications interfaces may also be used as a replacement for, or a supplement to, the keypad 104, and to enrich the communications abilities of the electronic lock 100. For example, the machine-readable optical identifier 103 may cause a mobile device to initiate download of an appropriate application for communications with the electronic lock 100, and/or may cause the mobile device to configure itself for wireless communications with the electronic lock 100 (e.g., by pairing the device, by setting authentication credentials, etc.). Then, lock identifiers, access codes, logs, etc. may be communicated wirelessly between the electronic lock 100 and the mobile device. For example, once a mobile device capable of NFC is configured for access to electronic lock 100, generation/communication of access codes may be initiated by bringing the electronic device near or into contact with the electronic lock 100.

With specific reference to Bluetooth communications, once a mobile device is paired with the electronic lock 100 via Bluetooth, communications between the mobile device and the electronic lock 100 can proceed over a Bluetooth connection (e.g., as opposed to using the machine-readable optical identifier 302 and/or the keypad 104 or other input device). Such communications can include log transfers, access code transfers, clock synchronization, etc. In some embodiments, use of Bluetooth may be able to eliminate the need to include a clock at the electronic lock 100 (e.g., since the electronic lock can rely on a clock at the mobile device, and/or the electronic lock can instruct the mobile device to perform computations that would normally be performed at the lock).

With specific reference to NFC, NFC can be used to communicate information between a mobile device and the electronic lock 100 (e.g., as opposed to using the dynamic machine-readable optical identifier 302 and/or the keypad 104 or other input device). For example, a user may enter a lock access portion of a mobile device user interface and initiate and access action (e.g., provide appropriate credentials). Then, the user may touch the mobile device to the electronic lock 100 (or bring the mobile device to within NFC communications distance from the electronic 100) to "apply" the action, at which time the mobile device and the electronic lock 100 communicate access code(s), logs, lock identifier(s), rule(s), or any other appropriate information to provide the user access to the lock (when authorized) and/or to synchronize the clock, the logs, or rules. In some embodiments, use of NFC may be able to eliminate the need to include a battery or other power source in the electronic lock 100, since the mobile device may be able to provide power to the electronic lock 100 over NFC. In some embodiments, the electronic lock 100 may employ RFID in addition to or as an alternative to NFC to perform one-way communications (i.e., from the lock to the mobile device, such as to provide the lock identifier to the mobile device).

In some embodiments, NFC and/or RFID may be used to facilitate Bluetooth pairing. For example, NFC may be used to provide Bluetooth pairing settings to a mobile device. As such, a user may merely need to touch the mobile device to the electronic lock 100 (or being the mobile device near the electronic lock 100) to initiate a Bluetooth parting between the electronic lock 100 and the mobile device.

In some embodiments, machine-readable optical identifiers can facilitate use of radio communications (e.g., Bluetooth, NFC, RFID, etc.). For example, by scanning a QR code with a mobile device, the device may be able to automatically initiate a Bluetooth connection, a user may be provided with data fields usable for manual Bluetooth pairing, instructions for Bluetooth pairing, instructions for use of NFC, educational materials (e.g., videos), etc. For example, in the context of version 2 of the Bluetooth protocol, scanning a QR code may provide the user with instructions for establishing a Bluetooth connection (e.g., instructions for configuring the iOS, Android, or Windows operating system to pair to the electronic lock 100), may provide the user with a shared secret necessary for establishing the Bluetooth connection (e.g., a code that will need to be entered at the user's device to complete the connection), or (for some devices) may cause the device to fully establish a Bluetooth connection. In another example, in the context of version 4 of the Bluetooth protocol, scanning a QR code may enable an application at the user's mobile device to automatically initiate a Bluetooth connection using a device identifier that is provided by the QR code. As such, in the context of version 4 of the Bluetooth protocol, scanning a QR code can initiate ad-hoc Bluetooth 4 transactions, with the device identifier coming from the QR code.

In some embodiments, the electronic lock 100 may provide radio communications functionality (e.g., Bluetooth, NFC, etc.) in addition to optical functionality. For example, mobile devices without NFC and/or Bluetooth capabilities may be useable with the electronic lock 100 using a machine-readable optical identifier and a keypad, while mobile devices having NFC and/or Bluetooth capabilities may be able to use the NFC and/or Bluetooth of the electronic lock 100.

In some embodiments, the electronic lock 100 communicates with a mobile device using visible light. For example, the electronic lock 100 may contain one or more cameras or photosensitive sensors, which can detect visible light that is generated by a mobile device (e.g., by a flash device, such as a LED, of the mobile device; by a display screen of the mobile device; etc.). As such, the mobile device can communicate data to the electronic lock 100 using visible light (e.g., by varying pulses, varying colors, varying intensities, etc.). In another example, the electronic lock 100 contains one or more light emission devices (e.g., LEDs), which can generate light for detection by the mobile device (e.g., by a camera of the mobile device). As such, the electronic lock 100 can communicate data to the mobile using visible light (e.g., by varying pulses, varying colors, varying intensities, etc.). Combinations of the foregoing are also possible, enabling two-way communications between the electronic lock 100 and the mobile device. For example, the electronic lock 100 can include both a light sensor (e.g., camera) and a light emission device (e.g., LED).

In some embodiments, the electronic lock 100 communicates with a mobile device using sound. For example, the electronic lock 100 may contain one or more microphones, which can detect sound that is generated by a mobile device. As such, the mobile device can communicate data to the electronic lock 100 using sound (e.g., by varying pulses, varying pitches, varying amplitudes, etc.). In another example, the electronic lock 100 contains one or more speakers or other sound generation devices (e.g., piezo, buzzer), which can generate sound for detection by the mobile device (e.g., by a microphone of the mobile device). As such, the electronic lock 100 can communicate data to the mobile using sound (e.g., by varying pulses, varying pitches, varying amplitudes, etc.). Combinations of the foregoing are also possible, enabling two-way communications between the electronic lock 100 and the mobile device. For example, the electronic lock 100 can include both a microphone and a speaker.

The electronic lock 100 can include one or more solar cells for charging the battery, and/or lighting such as keypad illumination, illumination of the machine-readable optical identifier 103, front- or back-lighting of a display, etc.

In some embodiments, one or more of the electronic components are in a powered-off or standby mode when not in use. In some embodiments, for example, all electronic components are in an off, standby, or other low power state when the electronic lock 100 has been idle for a specified period of time (e.g., one minute), or after the electronic lock 100 has performed some functionality (e.g., access code generation, transducer activation, etc.). In some embodiments, one or more of the electronic components are activated upon detection of user presence, such as by interaction with the keypad 104, motion detection, sound detection, detection of a light pattern, etc. In some embodiments, all electronic components are in an off state except for the RTC when the electronic lock 100 is idle.

In some embodiments, the electronic lock 100 saves power by computing its current access code only when a user is attempting to access the electronic lock. For example, the electronic lock 100 may be awoken when a user enters an access code, and the electronic lock 100 computes its access code after (or concurrent to) receiving the user's access code. As such, the electronic lock 100 may be capable of use for potentially years at a time without recharging or replacing the battery.

Figure 5:
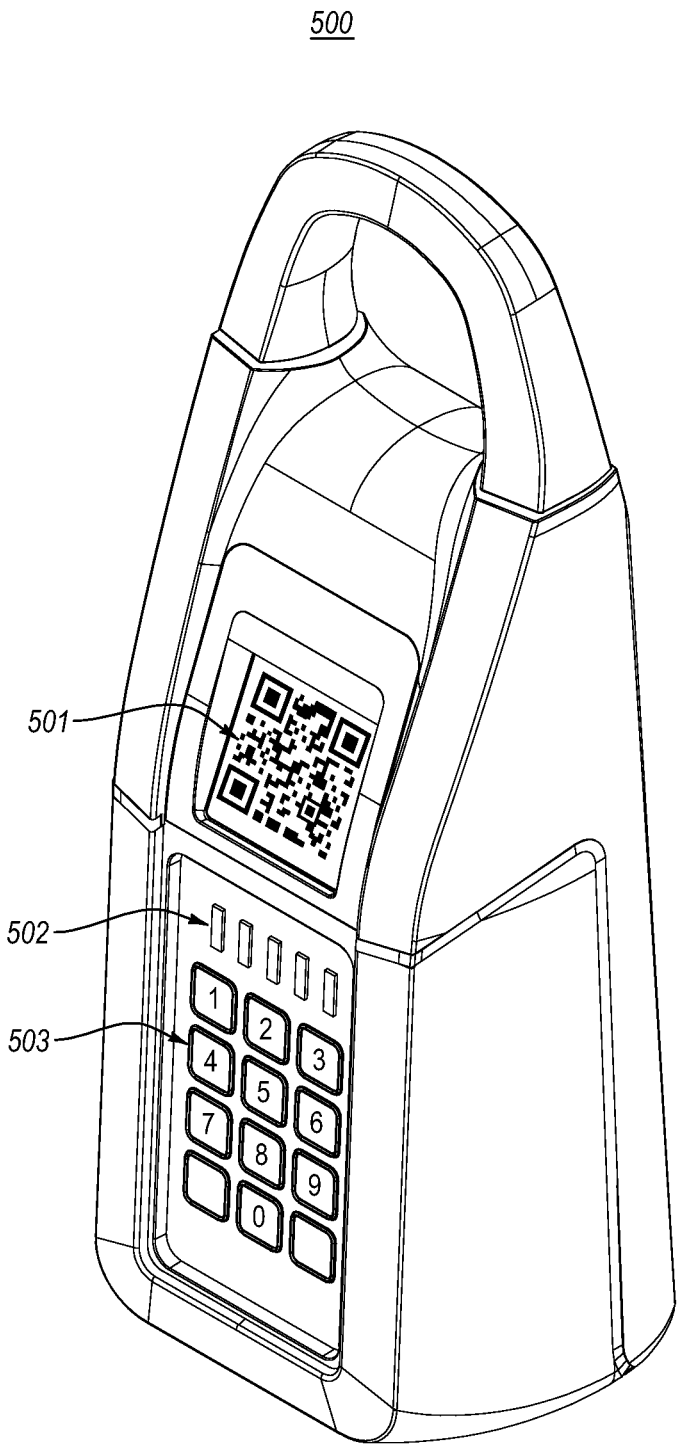
FIG. 5 illustrates an external view of an electronic lock, according to one or more embodiments.
Figure 6:
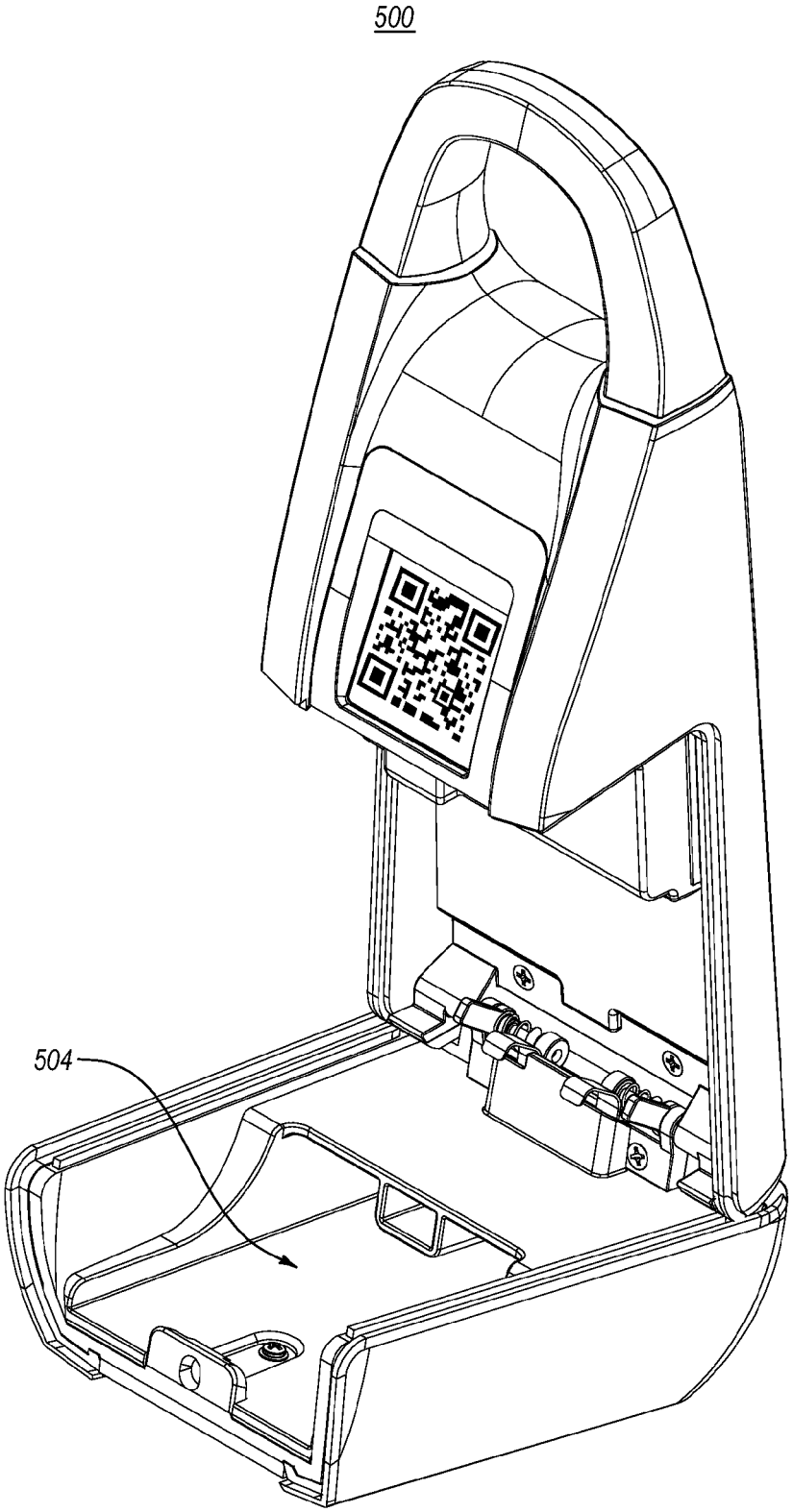
FIG. 6 illustrates an internal view of an electronic lock, according to one or more embodiments.

FIGS. 5 and 6 illustrate some views of one embodiment of an electronic lock 500. FIG. 5 illustrates and external view of the electronic lock 500, including a machine-readable optical identifier 501 (e.g., a QR code), a battery status display 502 (e.g., a row of LEDs), and a keypad 503 comprising two columns of buttons corresponding to digits. FIG. 6 depicts an internal view of the electronic lock 500, including a lockable compartment 504.

Communications with Other Devices and/or Services

Figure 7:
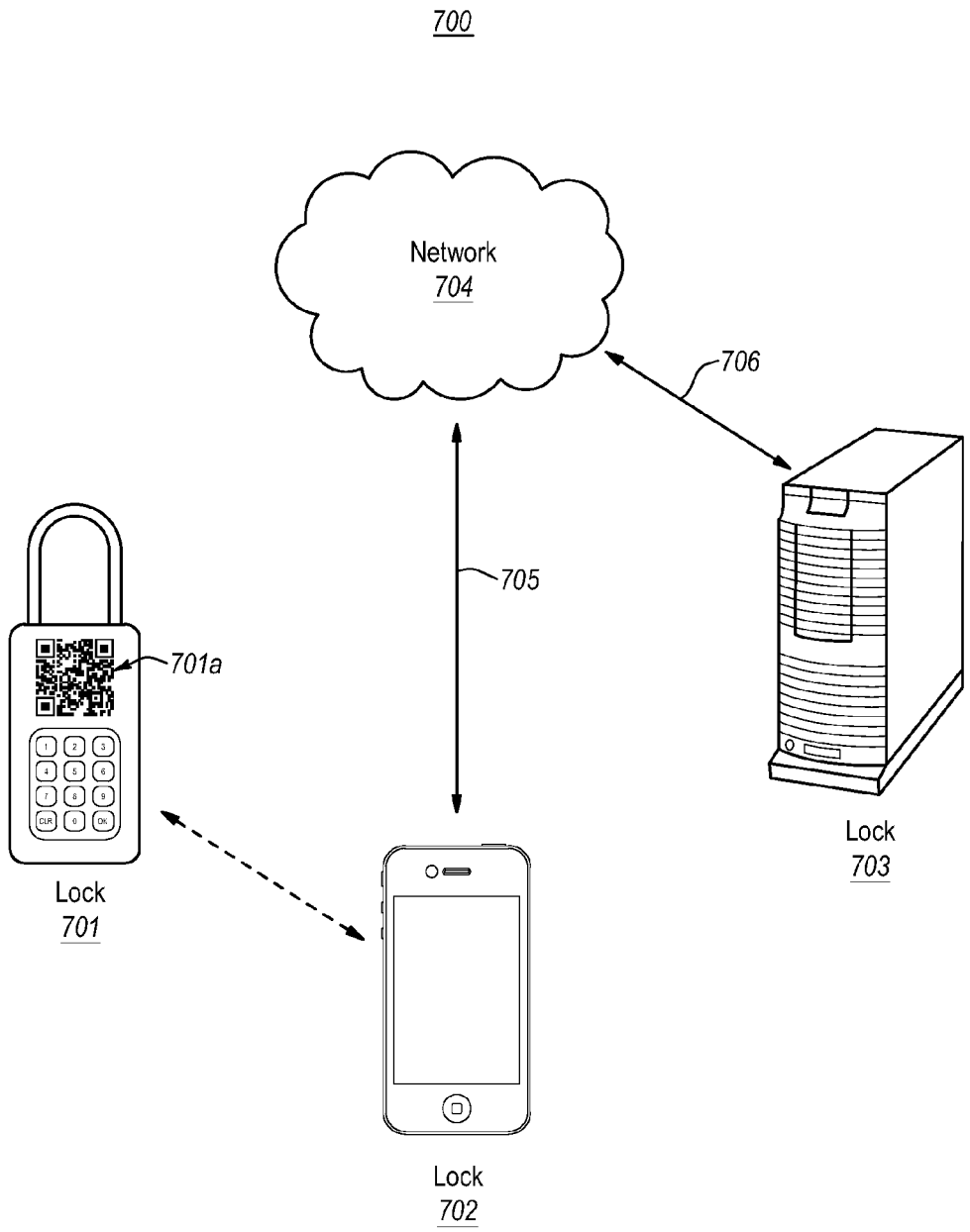
FIG. 7 illustrates a computing environment in which locks described herein may be used, according to one or more embodiments.

FIG. 7 illustrates a computing environment 700, according to one or more embodiments of the invention, in which the electronic lock 100 (or any other lock according to the disclosure herein, such as a mechanical lock or a lock having a sticker affixed thereto) may be used. As depicted, the computing environment 700 includes a lock 701 (e.g., the electronic lock 100) having a machine-readable optical identifier 701*a*, a mobile device 702, and a server 703. While only one lock is depicted, the computing environment 700 can include any number of locks. The mobile device 702 and the server 703 may be connected (at least occasionally) via a network 704 (e.g., a cellular network, a WAN, A LAN, or the Internet), as depicted by the arrows 705 and 706.

To gain access to the lock 701, a user may first configure the mobile device 702 with appropriate software. For example, the user may obtain the software from a website or software repository (e.g., an "app store"). In some embodiments, the user may scan the machine-readable optical identifier 701*a* to be directed to instructions for installing the software and/or to download the software from a website or a software repository.

Figure 8:
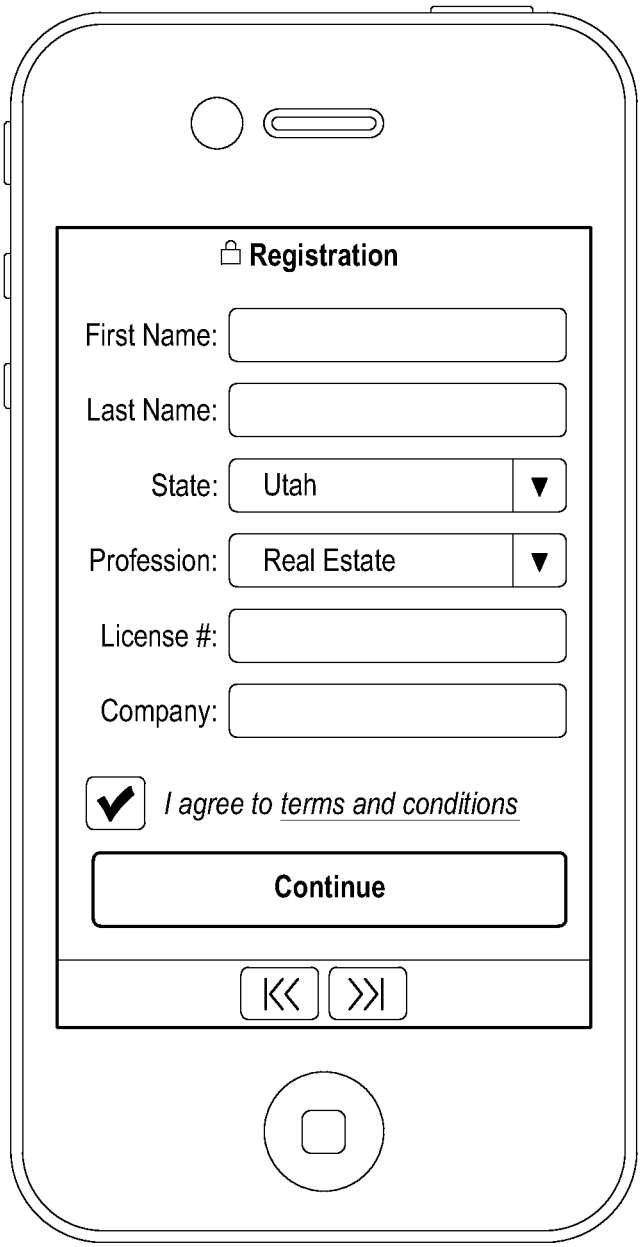
FIG. 8 illustrates a user registration user interface of a mobile device software application, according to one or more embodiments.

After installing the software, the user may be prompted to set up an account. For example, FIG. 8 illustrates an example user registration user interface of a mobile device software application. As depicted in FIG. 8, a user registration user interface may obtain any appropriate information, such as a user's name and contact information. In the case of real estate, the user's licensed state and real estate license number (or other applicable information) may also be obtained. As discussed later, the licensing information can be used to validate whether or not to allow a particular user access to a lock.

Figure 9:
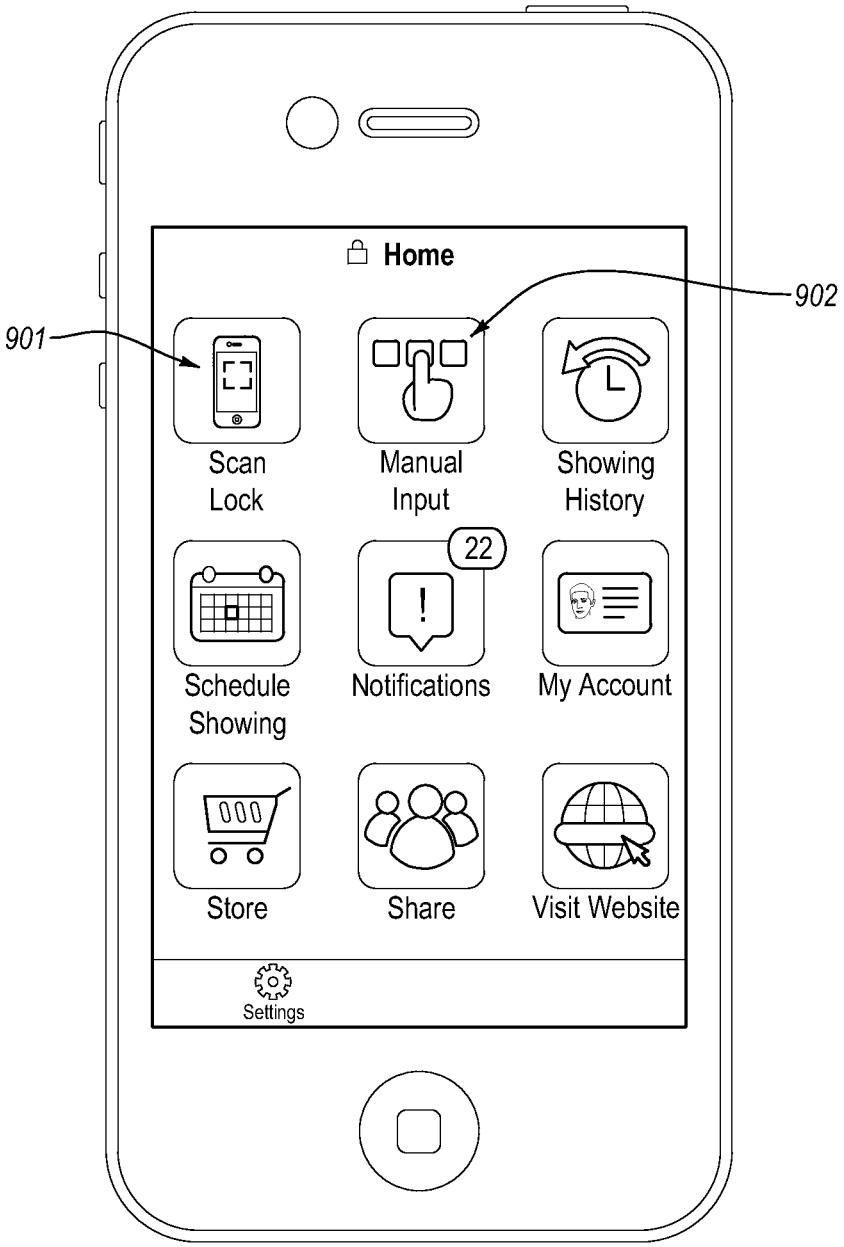
FIG. 9 illustrates a home user interface of a mobile device software application, according to one or more embodiments.
Figure 10:
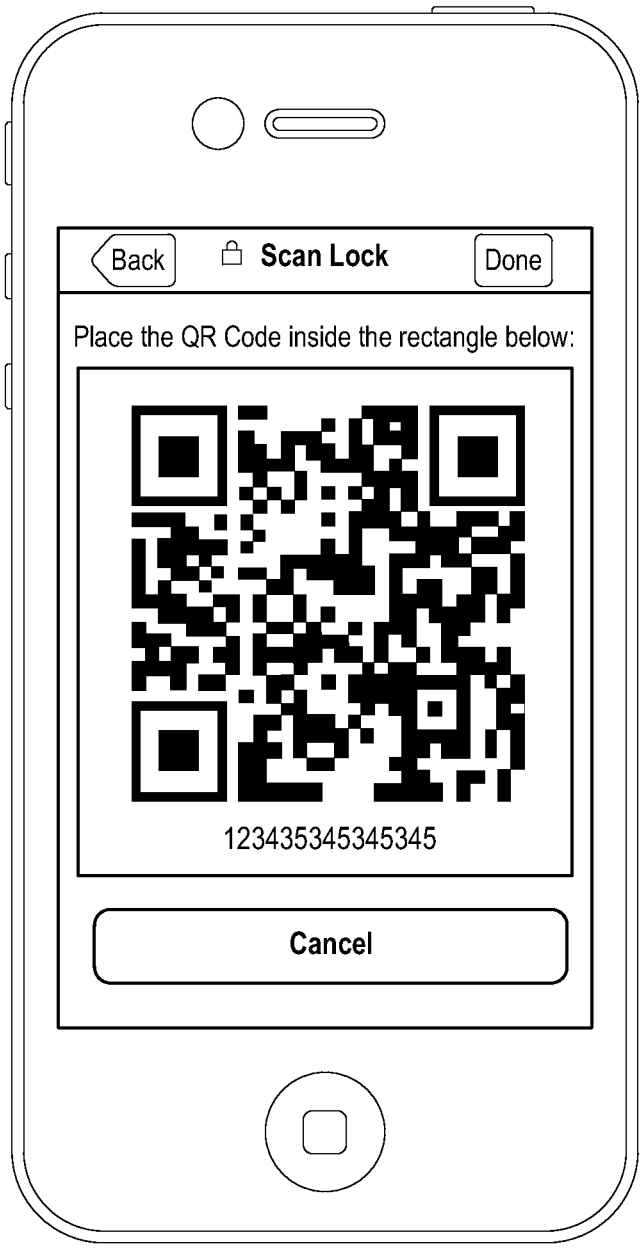
FIG. 10 illustrates a QR Code of a lock being scanned using a mobile device software application, according to one or more embodiments.
Figure 11:
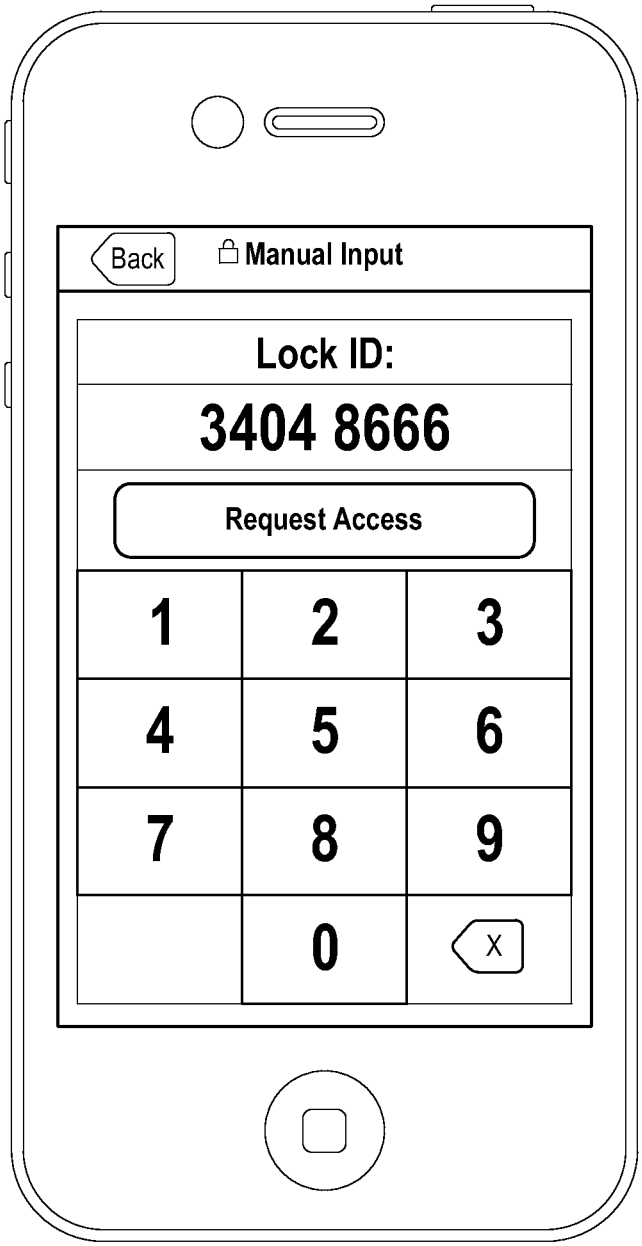
FIG. 11 illustrates a user interface of a mobile device software application that enables a user to enter the lock identifier manually, according to one or more embodiments.

FIG. 9 illustrates an example home user interface of a mobile device software application. As depicted, the home user interface includes a plurality of options, including a lock scan option 901 that, when selected, enables a user to scan the machine-readable optical identifier 701*a* of the lock 701. For example, FIG. 10 depicts a QR Code of a lock being scanned using the mobile device software application. Alternatively, the home user interface includes a manual input option 902 that, when selected, enables a user to manually input a lock identifier. For example, in addition to the machine-readable optical identifier 701*a*, the lock 701 may include a human-readable version of the lock identifier. FIG. 11 depicts a user interface that enables a user to enter the lock identifier manually.

Figure 12:
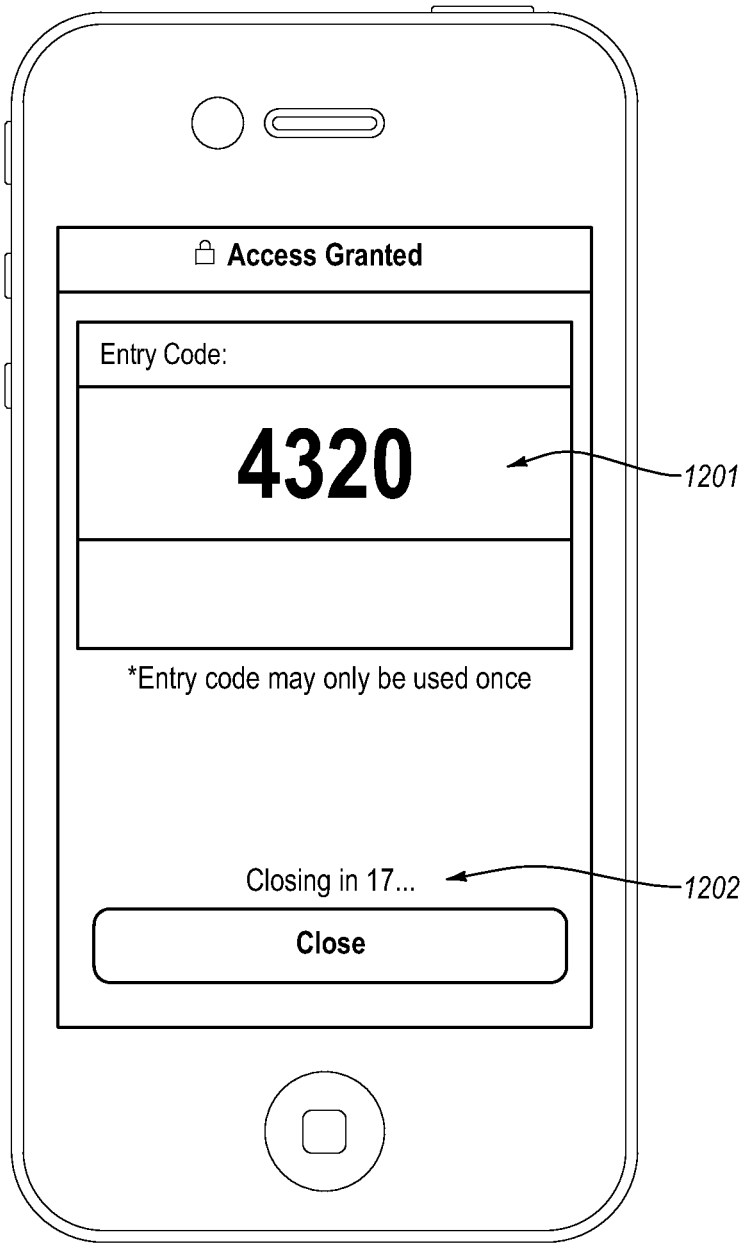
FIG. 12 illustrates an access granted user interface of a mobile device software application, according to one or more embodiments.

Whether the lock identifier was obtained optically or manually, the mobile device 702 can obtain an access code for the lock 701. For example, the mobile device 702 may send the lock identifier to the server 703 over the network 704 in an "online" mode of operation. Based on the lock identifier, the server 703 can generate an access code for the lock 701, and send the access code to the mobile device 702. The server 703 may also refuse to generate the access code for the lock 701 based on a set of server side rules. FIG. 12 illustrates an example access granted user interface of a mobile device software application, which presents the access/entry code 1201 to the user.

In another embodiment, the mobile device may calculate the access code itself in an "offline" mode of operation. For example, at a time when the mobile device 702 is in communication with the server 703, the mobile device 702 may obtain one or more server cryptographic keys from the server 703. The server cryptographic keys are usable for generating access codes based on a lockbox identifier. In some embodiments, the mobile device 702 obtains cryptographic keys for three periods (current, next, and two periods out). Then, when the mobile device 702 is used to access the lock 701, the mobile device 702 can generate an access code itself based on the cryptographic key(s).

In some embodiments, the access code 1201 is presented for only a short time, such as 10 seconds, 20 seconds, or 30 seconds, after which time the mobile device 702 closes the access granted user interface or hides the access code 1201. For example, FIG. 12 depicts a countdown 1202 showing the time remaining for reading the access code 1201. Limiting the time that the access code is presented helps ensure that users request access codes only when they are in physical presence of a lock, and discourages the user from memorizing or writing down the access code (e.g., when using a mechanical lock).

While in the case of an electronic lock 701 the access code will be valid for only a certain period, the access code may be valid for an extended amount of time if the period is long (e.g., one day). Furthermore, in the case of mechanical locks or locks with stickers, the access code may be static. As such, limiting a user's visual access to the code can help limit the user's extended access to the lock.

Figure 13:
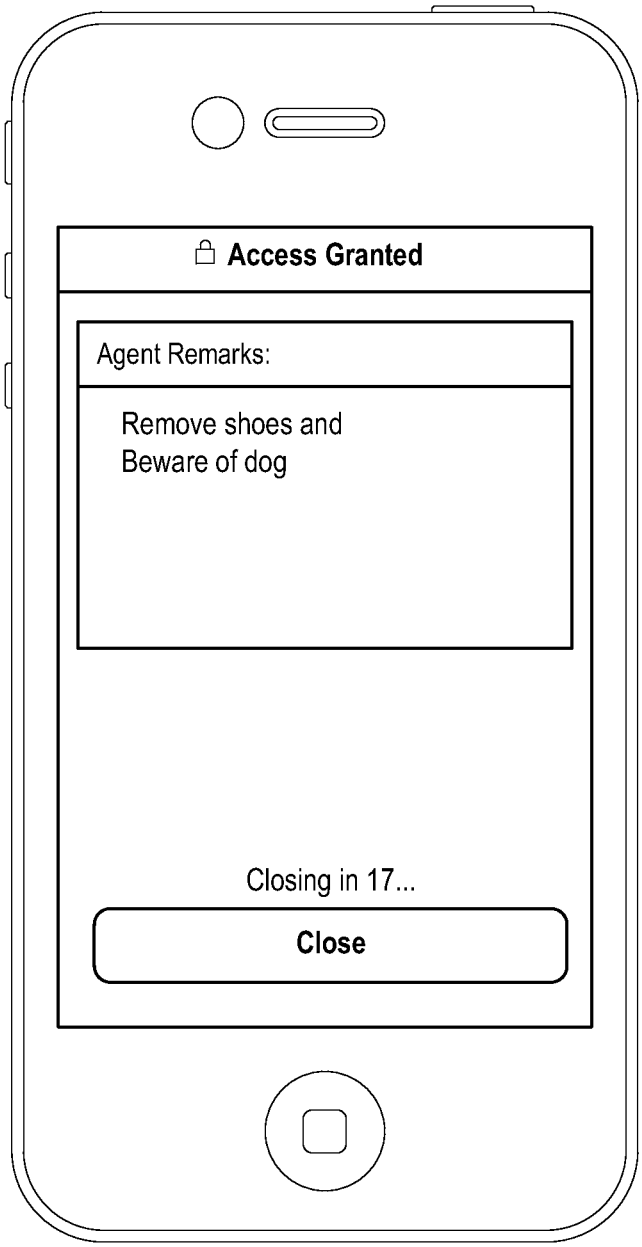
FIG. 13 illustrates a remarks screen of a mobile device software application, according to one or more embodiments.

FIG. 13 illustrates that the access granted user interface can also include a remarks screen, which can enable a lock owner/manager to provide comments to the person gaining access to the lock 701. For example, in the context of real estate, the comments may provide detail or instructions regarding the property being accessed (e.g., "Please remove shoes," "Beware of dog," "The door lock tends to stick," etc.).

In addition to sending the lock identifier to the server 703, the mobile device 702 may send one or more additional pieces of information to the server 703, such as user identification information, log information obtained from the lock 701, battery information obtained from the lock 701, time information obtained from the lock 701, etc. The server 703 can use information obtained from the mobile device 702 for any applicable purpose.

For example, the server 703 may use user identification information to verify whether the requesting user is permitted to access the lock 701*a*. In some embodiments, the server 703 uses real estate information (e.g., licensed state and real estate license number) to determine the status of the user's real estate license, and denies the user access to the lock 701 when the user's license is expired, revoked, etc. In another example, if the status of the user's license is expired, revoked, etc., the server 703 refuses to send server cryptographic keys to the mobile device 702, preventing the user from using the mobile device 702 in an offline mode of operation. The server 703 may also compare the user identification information against a whitelist of people permitted to access a lock, and/or a blacklist of people denied access to a lock.

The server 703 may also use lock information (e.g., logs, battery information, clock information) to update records at the server, or to direct personnel to take action with respect to the lock 701. For example, if the log information obtained from the lock 701 indicates that the server's logs are not in sync with the lock's locks, an event may be created which directs a person to go to the lock 701 to download its logs (e.g., with a USB mass storage device). In another example, if the battery information obtained from the lock 701 indicates that the battery is low, an event may be created which directs a person to go to the lock 701 to replace or charge its battery or replace the lock entirely. In yet another example, if the clock information obtained from the lock 701 indicates that the lock's clock has drifted to an unacceptable level, an event may be created which directs a person to go to the lock 701 to re-sync its clock or send the lock in for professional service and re-sync. In some embodiments, the clock information may be used to adjust the manner in which access codes are generated at the mobile device 702 or at the server 703, so as to adjust for clock drift at the lock 701.

Figure 14:
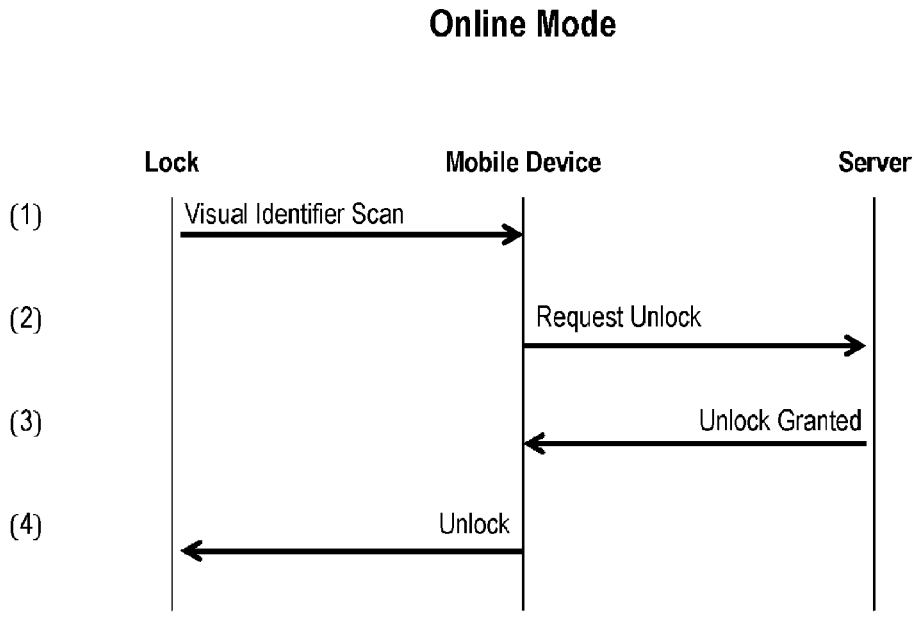
FIG. 14 illustrates a timing diagram of an online mode, according to one or more embodiments.
Figure 15:
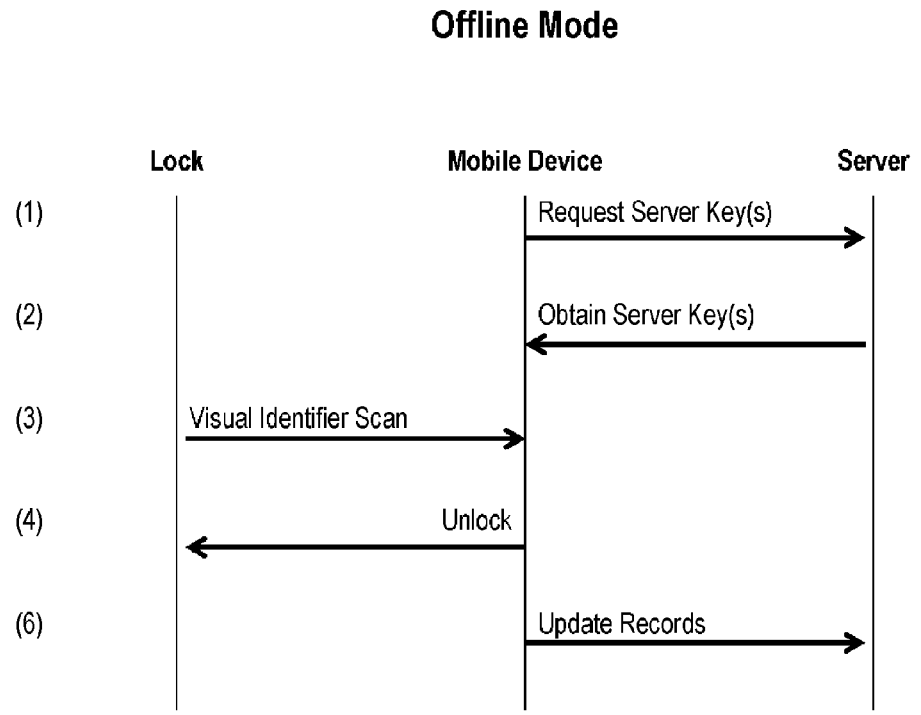
FIG. 15 illustrates a timing diagram of an offline mode, according to one or more embodiments.

As indicated above, the computer architecture 700 can operate in an online and/or an offline mode. The offline mode may be beneficial in situations where the mobile device 702 is being used to access a lock that is not within network coverage, such as an area with poor cellular reception. FIGS. 14 and 15 illustrate some example timing diagrams for the online and offline modes, respectively.

FIG. 14 illustrates that in the online mode a mobile device scans an optical identifier of a lock at time (1). During the scan, the optical identifier may communicate at least the lock identifier to the mobile device. Other fields that may be communicated can include a most recent log entry, a log hash and/or most recent log entry, a lock timestamp, a battery percentage, etc. At time (2), the mobile device sends an unlock request to the server. The unlock request includes at least the lock identifier. The unlock request can also include other data fields, such as user identification information (e.g., user name, realtor license number, realtor phone number), a mobile device timestamp, the lock timestamp, a geo-location of the mobile device, the battery percentage of the lock, a device identifier of the mobile device, etc. The server can use the user identification information to verify the user, and the geo-location of the mobile device can be used to track the current location of the lock. At time (3), the server grants the unlock request (if such permission is granted), and sends the access code to the mobile device (after having generated the access code in the case of an electronic lock, or looked up the access code in the case of a mechanical lock or a lock with a sticker). The server may also send remarks for the lock or for the item being secured (e.g., property remarks). At time (4), the mobile device displays the access code, and the user enters the access code at the lock. If the mobile device and the lock are in electronic communication, the mobile device may send the access code to the lock electronically.

FIG. 15 illustrates that in the offline mode, the mobile device can request one or more server keys at time (1). As part of the request, the mobile device can send user identification information, such as a realtor identifier, or a real estate license number and/or device identification information, such as a device identifier for the mobile device. The mobile device may also send the identities of one or more locks the mobile device desires to access. If the server determines that the mobile device/user is authorized to access the lock(s), the server can send the mobile device one or more server keys. Then, when (at time (3)) the mobile device scans a machine-readable optical identifier, the mobile device can use the server key(s) to generate the appropriate access code and provide the access code to the user and/or to the lock (at time (4)). At time (5), such as when the mobile device has entered cellular range, the mobile device can send an update request to the server to update the server's records of any access(es) performed by the mobile device.

Following is an example cryptographic scheme for use with computer architecture 700. One of ordinary skill in the art will recognize that the example cryptographic scheme may be modified in various manners, such as to use different functions. The example cryptographic scheme can include the following source variables:

lock time: $t_l$ server time: $t_s$ lock id: $id_l$ shared secret: k

The server can compute one or more cryptographic keys. For example, the server can compute three periods worth of cryptographic keys using a cryptographic (e.g., TOTP) function as follows:

server crypto key (current period): $c_{ts}$=TOTP(k, $t_s$)

server crypto key (next period): $c_{ts}$+1=TOTP(k, $t_s$+1)

server crypto key (two periods out): $c_{ts}$+2=TOTP(k, $t_s$+2)

When the computer architecture 400 is operating in the offline mode, one or more of $c_{ts}$, $c_{ts}$+1, or $c_{ts}$+2 are the values that the server transfers to the mobile device when it is connected to the network at time (2) in FIG. 15. These cryptographic keys are then used later when the mobile device is in offline mode.

The lock can also compute one or more cryptographic keys. For example, the lock can compute three periods worth of cryptographic keys using a cryptographic (e.g., TOTP) function as follows:

lock crypto key (previous period): $c_{tl}$−1=TOTP(k, $t_l$−1)

lock crypto key (current period): $c_{tl}$=TOTP(k, $t_l$)

lock crypto key (next period): $c_{tl}$+1=TOTP(k, $t_l$+1)

The lock can also compute access codes for three periods using a hash (e.g., SHA1) as follows:

access code (previous period): $u_{tl}$1=SHA1(concat($c_{t1}$−1, $id_l$))

access code (current period): $u_{tl}$=SHA1(concat($c_{tl}$, $id_l$))

access code (next period): $u_{tl}$+1=SHA1(concat($c_{tl}$+1, $id_l$))

Finally, the server or the mobile device (if it has been provided the server crypto keys) can compute an access code for the current period as follows:

access code: up=SHA1(concat($c_{ts}$, $id_l$))

In the case of a mobile device, the mobile device may use the crypto keys for the next period ($c_{ts}$+1) or two periods out ($c_{ts}$+2) instead of for the current period ($c_{ts}$), depending on how long it has been since the mobile device obtained the server crypto keys.

In some embodiments, the lock can compare a received access code against the previous access code ($u_{tl}$−1) and/or the next access code ($u_{tl}$+1) if the received access code does not match the current access code ($u_{tl}$) Doing so can help the lock adapt for instances where clock drift has caused the lock to be in a different period than the server. More generally, the lock can compare the received access code against a plurality of internally computed access codes (e.g., several previous codes and several future codes) to account for possible clock drift. The lock may also statistically measure its clock drift, and use these statistical measurements to self-correct its clock to reduce the amount of drift.

In some embodiments, a mobile device can be used to achieve a more granular time period than would otherwise be possible using only a clock at the electronic lock 100. For example, once the mobile device gets the server crypto key(s), the mobile device may use its internal clock to perform an additional TOTP iteration using these key(s) to obtain a smaller time period than the time period on which the server crypto key(s) are based.

In some embodiments, rather than using a rotating code (e.g., TOTP function), the electronic lock 100 is configured to interpret and validate encrypted static codes that specify valid access times, and to grant access when a valid code is received during an active access time period. In one particular non-limiting example, a code may comprise a predetermined number of bytes or digits (e.g., ten). A first number of bytes or digits (e.g., four) may be used to specify a valid start time period (e.g., using a count of a number of clock cycles, a count of time units such as milliseconds or seconds, time since UNIX epoch, a date/time format, or any other appropriate time representation), and a second number of bytes or digits (e.g., four) may be used to specify a valid end time period. An additional number of digits or bytes (e.g., two) may be used to specify a checksum that can be used when validating the code. In addition, all or a part of the code may be encrypted or encoded, such as using a shared key. For example, the portion of the code encoding the start and end times may be encrypted/encoded, or the entire code including the checksum may be encrypted/encoded. Depending on the implementation, the checksum may be applied prior to or subsequent to the encrypting/encoding.

When the electronic lock 100 receives a code, the electronic lock decrypts/decodes the code using the shared key, and verifies the code with the checksum. When the code is valid, the electronic lock 100 interprets the start and end times specified in the code and grants access to the contents of the electronic lock 100 when the current time is within the start and end times specified in the code. The electronic lock 100 can receive the code in any appropriate manner described herein, such as with a keypad, through wireless radio communications (e.g., Bluetooth, NFC), through light communication (e.g., visible or infrared), through sound communications, etc.

Use of codes that specify valid access times, rather than rotating access codes, may be of use when granting access to rental properties. For example, an electronic lock 100 containing a key or access card for a rental property may be contained in the electronic lock 100. In connection with renting the property, a person may be provided with an access code (e.g., such as one generated by a server or other computer system having a shared key with the lock) that specifies as start and end times that correspond with the rental period of the property. For example, the person may scan a QR code at the electronic lock with a mobile device to receive the lock identifier and receive the access code from a server, or the person may be provided the access code as part of the rental process (e.g., through an e-mail). Through the code, the person is granted access to the key or access card for a rental property during their rental period, but not prior to the rental period or subsequent to the rental period.

Electronic locks may include a variety of additional technologies and configurations. For example, in some embodiments an electronic lock may include a camera. The camera may be usable to validate a user (e.g., facial recognition), to receive information from a mobile device (e.g., to scan a machine-readable optical identifier that is being displayed at a mobile device), to provide a visual record of an access event, etc. In some embodiments, an electronic lock may include a biometric authentication device, such as a fingerprint scanner, that can be used to validate users. In some embodiments, an electronic lock may synchronize to an external clock source, such as a GPS signal, a radio signal, etc.

Mechanical Lock

Figure 16:
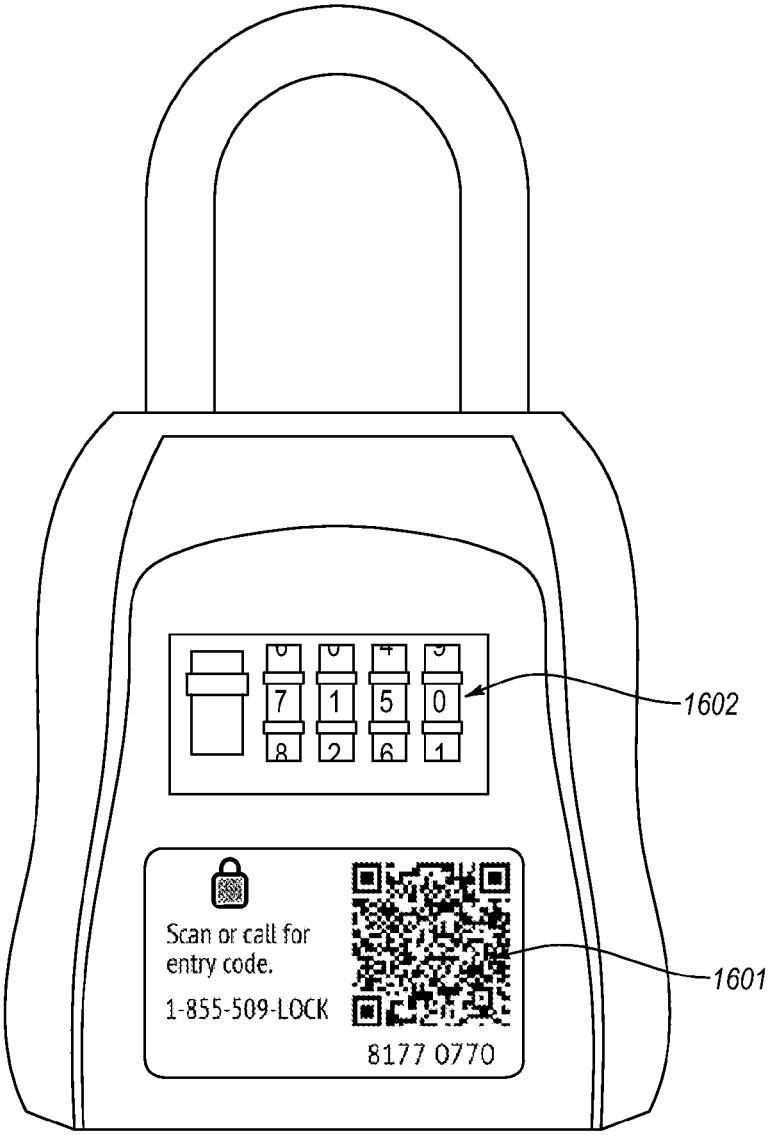
FIG. 16 illustrates a mechanical lock, according to one or more embodiments.

FIG. 16 illustrates an embodiment of a mechanical lock 1600 according to one or more embodiments of the invention. As depicted, the mechanical lock 1600 includes a machine-readable optical identifier 1601 and a combination 1602 entry mechanism. A user may scan the machine-readable optical identifier 1601 with the mobile device 702 to obtain a combination code for the mechanical lock 1600. In some embodiments, the mechanical lock 1600 includes a single static combination code, which the mobile device 702 obtains from the server 703 based on a lock identifier identified from the machine-readable optical identifier 1601.

In other embodiments, the mechanical lock 1600 includes a predictably changing combination code (e.g., round-robin set of codes, or codes that are mechanically generated in a predicable manner). In some embodiments, the mechanical lock 1600 includes a counter that displays the number of times the mechanical lock 1600 has been unlocked. When a user desires to unlock mechanical lock 1600, the server 703 and/or the mobile device 702 can provide the next valid access code to the user. The server 703 and/or mobile device 702 may obtain the next valid access code by tracking the last code provided, by receiving a currently-displayed code from the user, by receiving the count that is displayed counter (either from computer recognition or from a manual entry from the user), etc.

Stickers (Adhesives)

Figure 17:
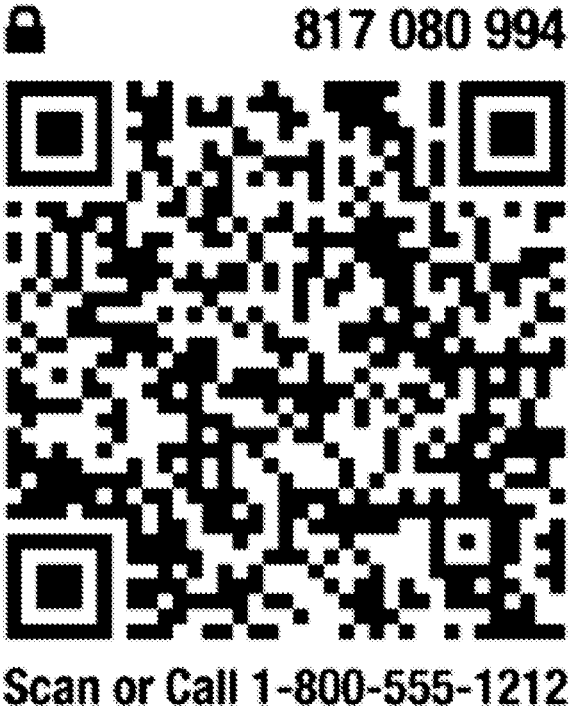
FIG. 17 illustrates stickers or adhesives, according to one or more embodiments.
Figure 17:
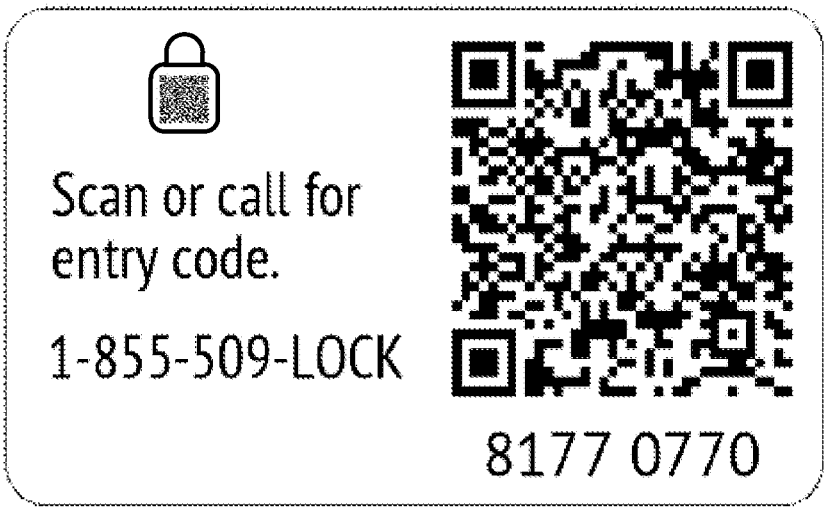

FIG. 17 illustrates stickers/adhesives, according to one or more embodiments, that may be affixed to a conventional lock (e.g., padlocks, conventional mechanical lockboxes, conventional electronic lockboxes, garage door openers, etc.) and that include machine-readable optical identifiers. These stickers/adhesives provide a lock identifier for any lock that a user desires to manage using the embodiments described herein. Since a conventional lock would typically have a static access code, scanning of a sticker would provide the user access to the static access code, after being authenticated and verified by the server 703 as being a valid and authorized user. In addition to facilitating the dissemination of access codes for conventional locks, the use of the stickers/adhesives described herein enable the logging and scheduling of access to these conventional locks.

Phone Call

Embodiments also include enabling a user to access a lock without a mobile device that is not configured for access with a server (e.g., a "feature phone"), and without scanning a machine-readable optical identifier. In this embodiment, a user calls a phone number affixed to the lock. Once the phone call is connected, an operator or a computer system prompts the user for a lock identifier, and any other applicable information such as user identity information, location information, phone system caller ID, etc. The computer system may verify the user based on received user information and, depending on the type of lock being accessed, the computer system produces an access code for the user by looking up a static code, by predicting the next code for a mechanical lock, or by executing a cryptographic algorithm for an electronic lock. The access code can then be given to the user over the phone or sent to the user via SMS/MMS.

Desktop User Interfaces

Embodiments include user interfaces for interacting with the server 703. For example, the server 703 may present one or more desktop (e.g., web) interfaces and/or one or more application programming interfaces (APIs) for interacting with the server 703. FIGS. 18-21 depict some example desktop interfaces, which illustrate some example functionality that the server 703 may present to end-users and/or administrators within the context of locks used in the real estate industry. In some embodiments, the desktop interfaces present analogous (though potentially more extensive) functionality to the functionality of mobile user interfaces.

Figure 18:
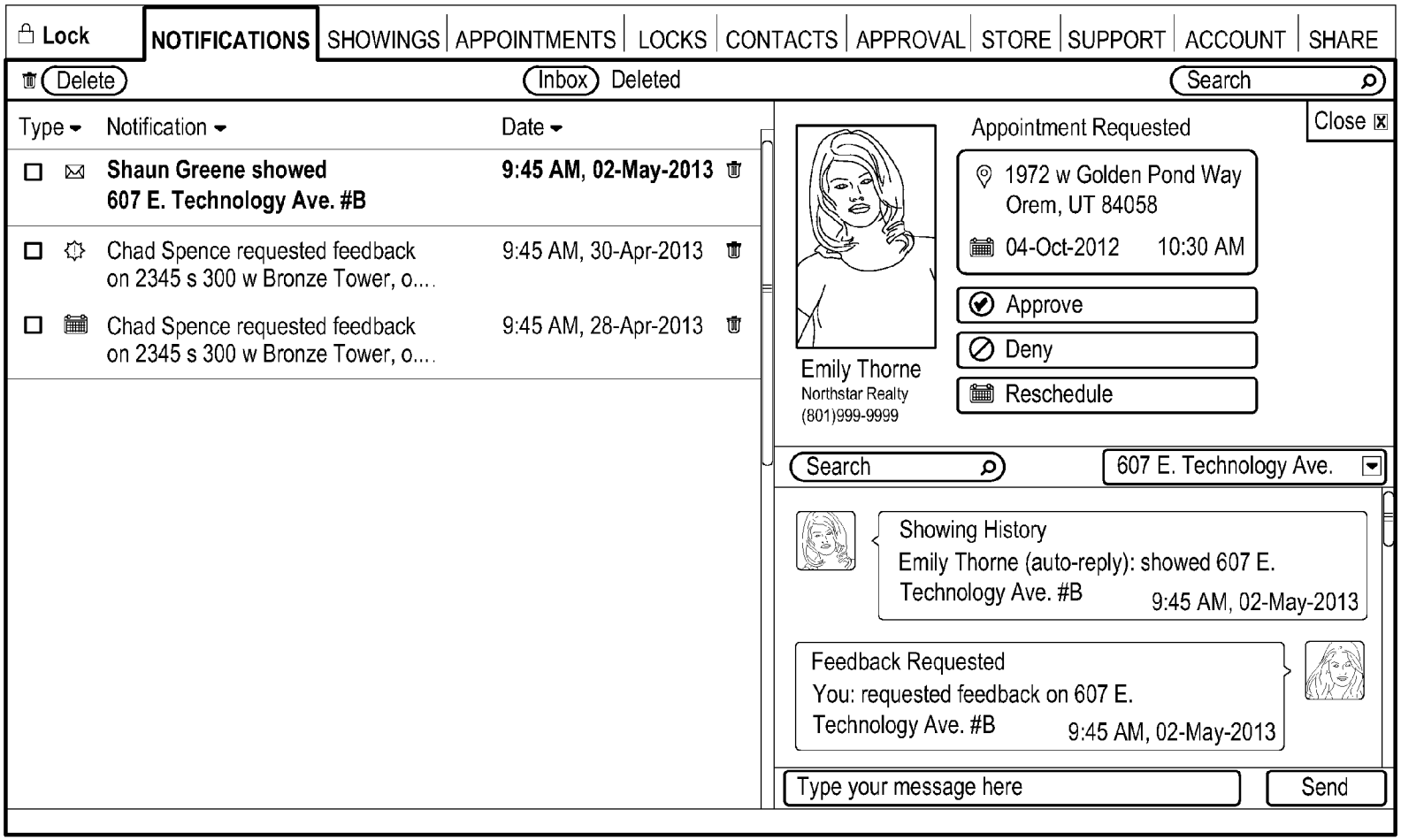
FIG. 18 illustrates a notifications desktop interface, according to one or more embodiments.

In the depicted desktop interfaces, locks are associated with the properties that the locks secure or provide access to. FIG. 18, for example, illustrates a notifications desktop interface. Generally, the notifications desktop interface presents a central "inbox" where events that are applicable to a particular user appear. Events may include system-generated messages, showings, appointment requests, entry requests, showing feedback, etc. Examples of notifications may include notifications of when a property has been accessed, feedback on properties, appointment creation/cancellation, etc.

Figure 19:
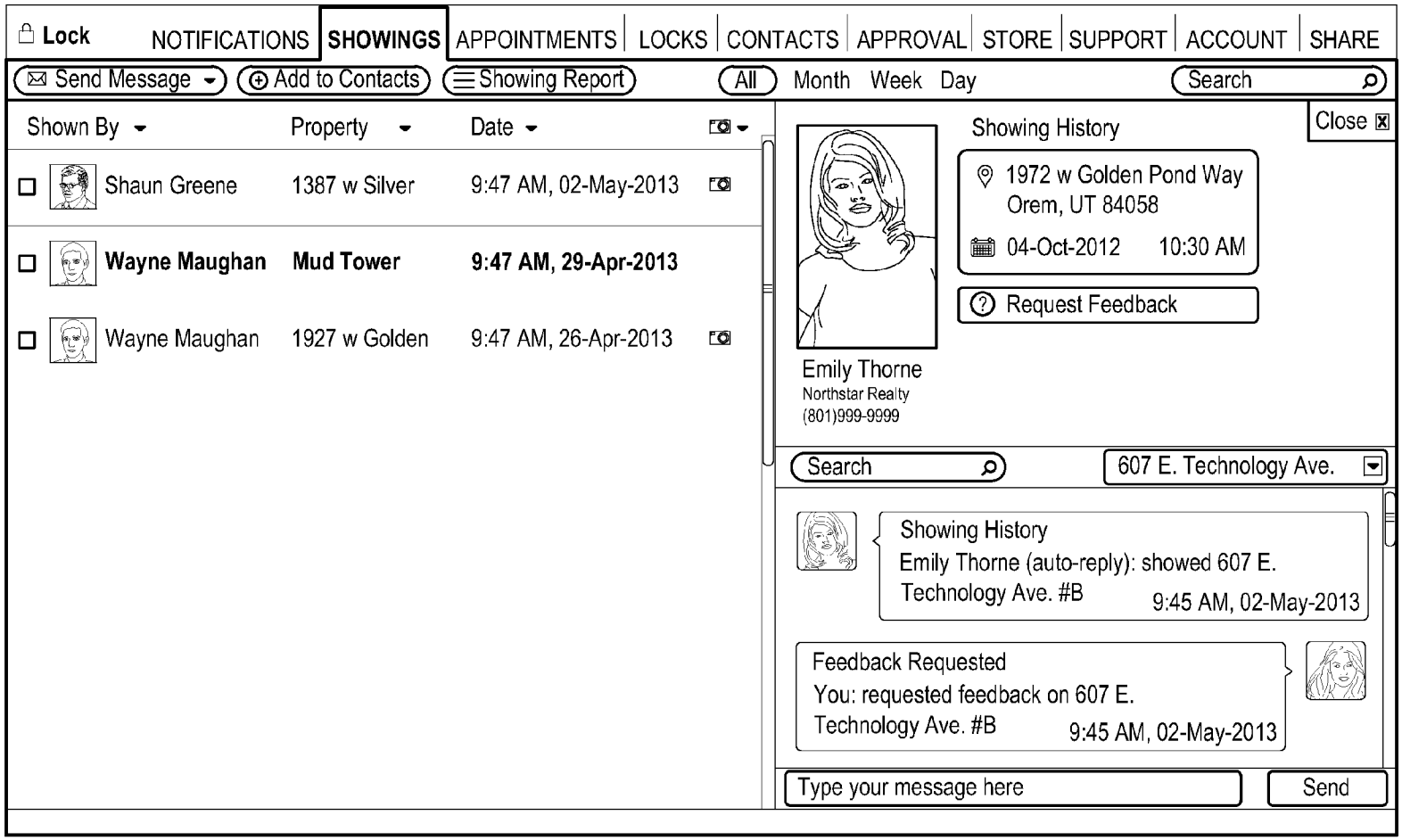
FIG. 19 illustrates a showings desktop interface, according to one or more embodiments.

FIG. 19 illustrates an example showings desktop interface. Generally, the showings desktop interface includes entry for when the user shows a listed property (i.e., its lock has been accessed by the user), or when the user's listed property has been shown (i.e., when its lock has been accessed by another agent). To enhance the user experience, individuals can quickly be identified by name and photo. Hovering a mouse pointer over the photo presents additional details and/or adds the individual to that user's list of contacts. From the showing area, a user can also create a detailed showing reports, request feedback, send a custom message to other users, chat with an individual, etc.

Figure 20:
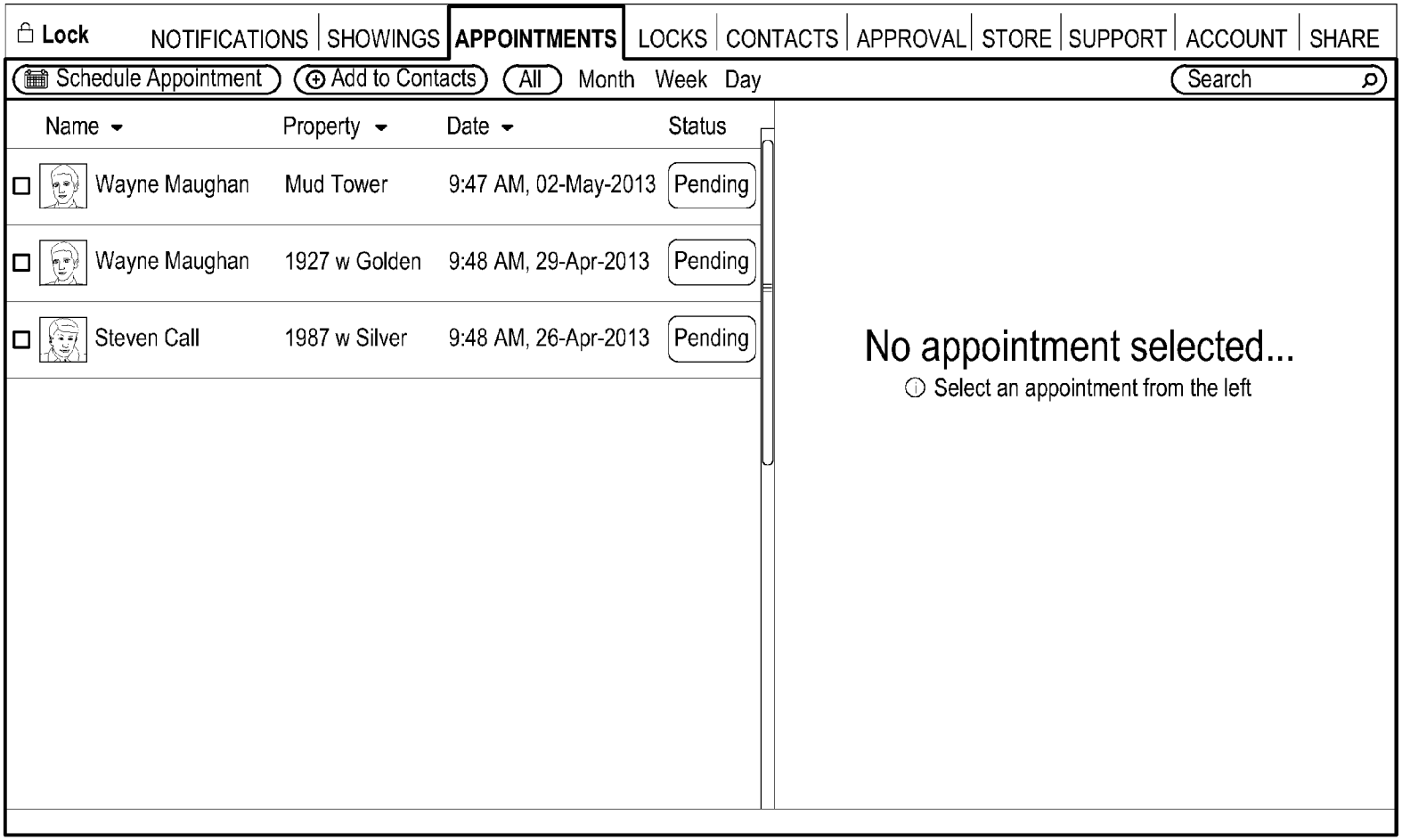
FIG. 20 illustrates an appointments desktop interface, according to one or more embodiments.

FIG. 20 illustrates an example appointments desktop interface. The appointments desktop interface enables the user to manage appointments, or schedule an appointment for properties that require an appointment prior to entry. When an appointment has been requested (but not approved) it appears on the top of the appointments listing as a "pending" appointment. Once the appointment has been approved it appears as "approved." The appointments desktop interface also enables appointments to be rescheduled.

Figure 21:
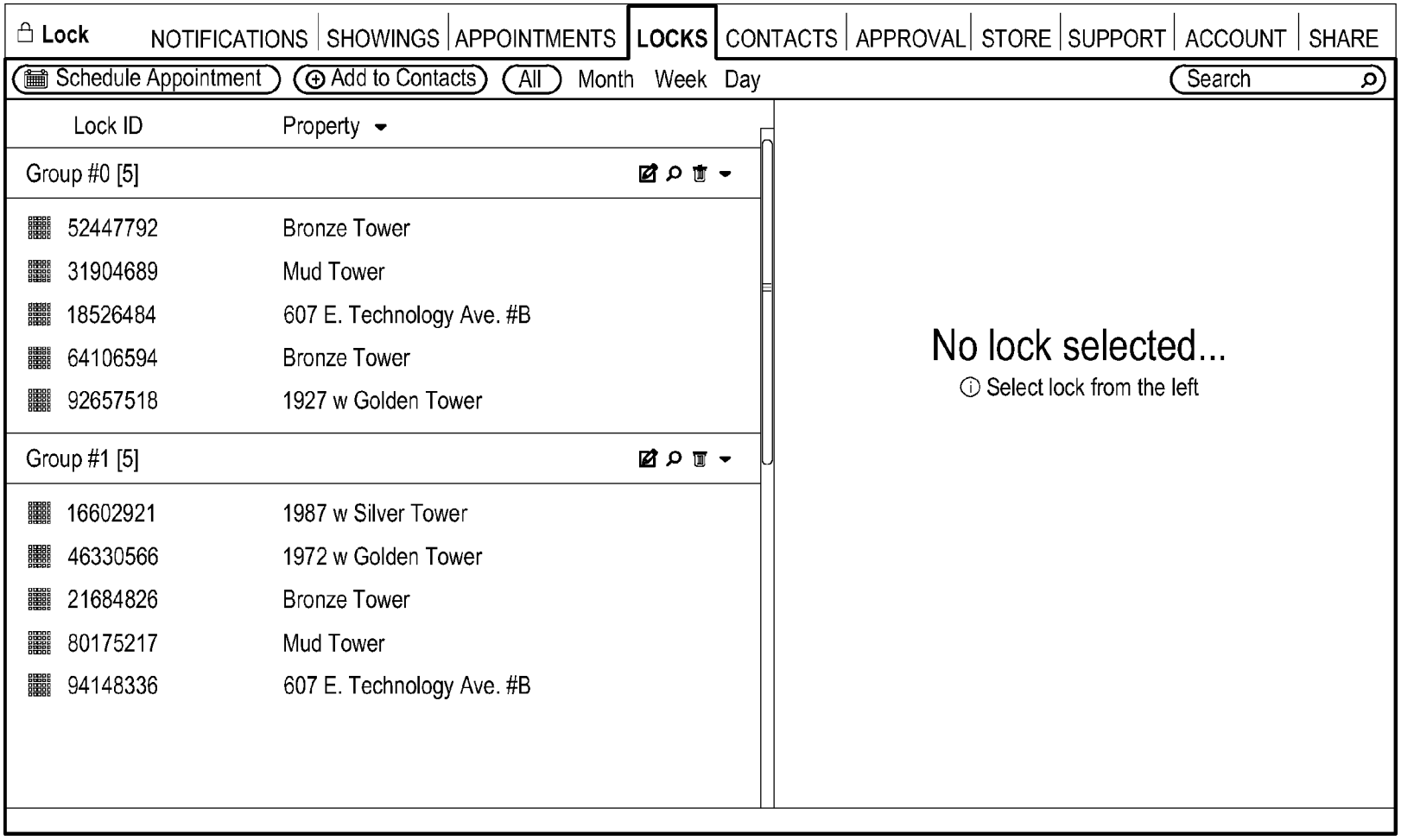
FIG. 21 illustrates a locks desktop interface, according to one or more embodiments.

FIG. 21 illustrates an example locks desktop interface. The locks desktop interfaces enables the user to manage an inventory of locks, such as electronic locks, mechanical locks, or locks with stickers attached thereto. The locks desktop interface enables the user to add a lock/property association, to remove a lock/property association, and to reassign a lock to a new property. The locks desktop interface may also enable lock-related settings to be set or changed. Settings may include permissions (e.g., a whitelist of approved users or a blacklist of banned users), appointments, co-agents assigned, seller notifications, etc. The locks desktop interfaces may enable a user to create groups to organize his/her locks.

Embodiments will now be described in the form of acts of one or more methods, with reference to one or more of the preceding Figures. It will be appreciated that the methodical acts may be performed in any appropriate order, and are not limited to the order described or illustrated.

Figure 22:
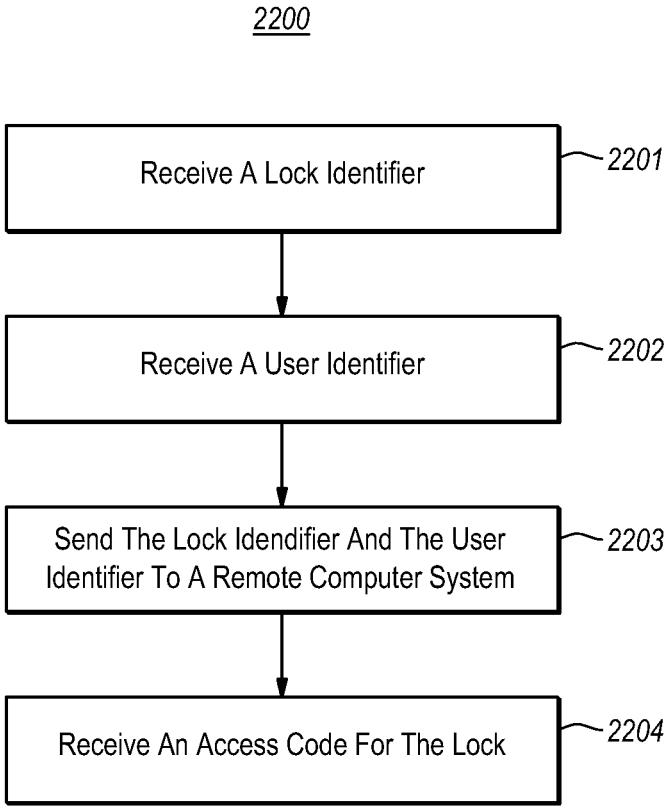
FIG. 22 illustrates a flowchart of a method for providing an unlock code for a lock, according to one or more embodiments.

FIG. 22 illustrates a flow chart of an example method 2200 for providing an unlock code for a lock. Method 2200 will be described with respect to the components and data of computer architecture 700.

As depicted, the method 2200 includes an act 2201 of receiving a lock identifier. Act 2201 can comprise receiving a lock identifier for a lock. For example, with reference to FIG. 7, the mobile device 702 can receive a lock identifier of the lock 401. The lock identifier can be received in any of the manners described herein, such as through scanning of a machine-readable identifier (e.g., 701*a*), through manual entry at the mobile device 702, through Bluetooth, NFC, light, or audio communications, etc.

The method 2200 also includes an act 2202 of receiving a user identifier. Act 2202 can comprise receiving a user identifier identifying a user of the mobile computer system. For example, an application running at the mobile device 702 can identify a user of the mobile device 702, such as through user credentials that have been entered at the application.

The method 2200 also includes an act 2203 of sending the lock identifier and the user identifier to a remote computer system. For example, the mobile device 702 can send the lock identifier of the lock 701 and the user identifier of a user using the mobile device 702 to the server 703 through the network 704.

The method 2200 also includes an act 2204 of receiving an access code for the lock. Act 2204 can comprise, based on sending the lock identifier and the user identifier to the remote computer system, receiving an access code for the lock. For example, the server 703 can send an access code for accessing the lock 701 to the mobile device 702 through the network 704. The access code may be generated based on a rotating code (e.g., one that is based on a time-based cryptographic algorithm that executes at both the server 703 and at the lock 701), may be a static access code (e.g., one that specifies an access start time and an access end time), or may be an access code for use at a mechanical lock (e.g., mechanical lock 1600 or a lock having a sticker applied thereto, see FIG. 17).

As such, the method 2200 can be used by a user of the mobile device 702 to gain an access code for the lock 701, which can then be entered at the lock 701 in any of the manners described herein.

Figure 23:
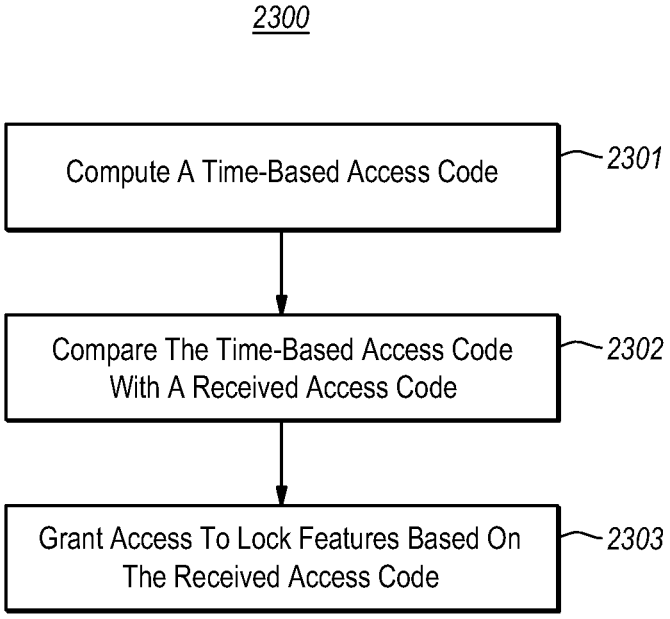
FIG. 23 illustrates a flowchart of a method for validating an access code, according to one or more embodiments.

FIG. 23 illustrates a flow chart of an example method 2300, executed at an electronic lock, for validating an access code. Method 2300 will be described with respect to the components and data of computer architecture 700.

As depicted, the method 2300 includes an act 2301 of computing a time-based access code. Act 2301 can comprise executing a time-based cryptographic algorithm to compute a time-based access code. For example, the lock 701 can execute a cryptographic (e.g., TOTP) function that generates different access codes based on the current time. A similar cryptographic function may be executed at the server 703 and/or the mobile device 702, such that the lock 701 and the server 703/mobile device 702 generate the same access code during the same time interval.

The method 2300 also includes an act 2302 of comparing the time-based access code with a received access code. For example, the lock 701 can compare the computed time-based access code with an access code that is received from the mobile device 702 (or a user of the mobile device 702).

The method 2300 also includes an act 2303 of granting access to lock features based on the received access code. Act 2303 can comprise granting access to one or more lock features when the time-based access code matches the received access code. For example, the lock 701 may unlock, or provide access to a compartment containing key(s) or access card(s) when the time-based access code matches the received access code.

Figure 24:
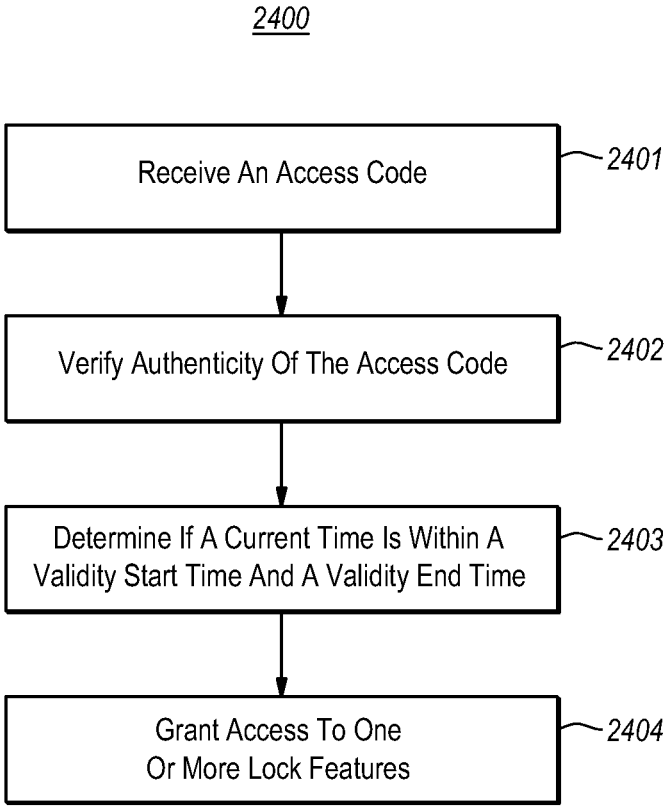
FIG. 24 illustrates a flowchart of a method for validating an access code, according to one or more embodiments.

FIG. 24 illustrates a flow chart of an example method 2400, executed at an electronic lock, for validating an access code. Method 2400 will be described with respect to the components and data of computer architecture 700.

As depicted, the method 2400 includes an act 2401 of receiving an access code. Act 2401 can comprise receiving an access code that includes a validity start time and a validity end time. For example, the lock 701 can receive a static access code from the mobile device 702, or from a user directly. The access code may include different data fields, including a validity start time and a validity end time.

The method 2400 also includes an act 2402 of verifying authenticity of the access code. For example, the lock 701 can decrypt/decode the access code with a shared key (e.g., one shared with the server 703), and/or verify a checksum of the access code, to verify the authenticity of the access code.

The method 2400 also includes an act 2403 of determining if a current time is within a validity start time and a validity end time. For example, the lock 701 can reference an internal clock, to ensure that the current time is within the validity start time and a validity end time specified by the access code.

The method 2400 also includes an act 2404 of granting access to more or more lock features. Act 2404 can comprise, when the current time is within the validity start time and the validity end time, granting access to one or more lock features. For example, when the current time is within the validity start time and a validity end time specified by the access code, the lock 701 may unlock, or provide access to a compartment containing key(s) or access card(s).

Accordingly, the embodiments described herein can provide for electronic lockboxes that provide enhanced security, through inclusion of electronic hardware and software/firmware that can validate access codes (either rotating or static) to provide access to the contents of the lockboxes. In addition, the embodiments described herein can provide for electronic lockboxes that may communicate directly with a mobile computing device, including communicating status, logs, and code/security information. In addition, the embodiments described herein can provide mechanical lockboxes and stickers that can extend secure user access to situations not involving an electronic lockbox.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. An electronic lock, comprising:
a dynamic display device;
an input device; and
one or more processors that are configured to:
execute a time-based cryptographic algorithm to compute a time-based access code;
cause the dynamic display device to display a machine-readable optical identifier that encodes at least a lock identifier of the electronic lock, along with at least one of:
a time received from a clock at the electronic lock,
a battery level of a battery at the electronic lock,
a log entry of a log at the electronic lock,
a log entry count of the log at the electronic lock, or
a hash of the log at the electronic lock;
based at least on displaying the machine-readable optical identifier at the dynamic display device, receive an access code at the input device;
compare the time-based access code with the received access code; and
grant access to one or more lock features when the time-based access code matches the received access code.

2. The electronic lock as recited in claim 1, wherein the machine-readable optical identifier encodes the time received from the clock at the electronic lock.

3. The electronic lock as recited in claim 1, wherein the machine-readable optical identifier encodes the battery level of the battery at the electronic lock.

4. The electronic lock as recited in claim 1, wherein the machine-readable optical identifier encodes the log entry of the log at the electronic lock.

5. The electronic lock as recited in claim 1, wherein the machine-readable optical identifier encodes the log entry count of the log at the electronic lock.

6. The electronic lock as recited in claim 1, wherein the machine-readable optical identifier encodes the hash of the log at the electronic lock.

7. The electronic lock as recited in claim 1, wherein the one or more processors are also configured to pair with a mobile device using one or more radios.

8. The electronic lock as recited in claim 1, wherein the input device comprises one or more radios.

9. The electronic lock as recited in claim 1, wherein the input device comprises a keypad.

10. The electronic lock as recited in claim 1, wherein the one or more processors are also configured to grant access to the one or more lock features only during periods of time defined by one or more rules.

11. The electronic lock as recited in claim 1, wherein the input device comprises one or more photosensitive sensors.

12. The electronic lock as recited in claim 1, wherein the time-based access code is valid between a defined start time and end time.

13. The electronic lock as recited in claim 1, wherein the one or more processors are also configured to verify authenticity of the received access code.

14. The electronic lock as recited in claim 13, wherein verifying authenticity of the received access code comprises decrypting or decoding the access code with a shared key.

15. The electronic lock as recited in claim 13, wherein verifying authenticity of the received access code comprises verifying a checksum of the received access code.

16. An electronic lock, comprising:
at least one radio configured for Bluetooth communications; and
one or more processors that are configured to:
execute a time-based cryptographic algorithm to compute a time-based access code;
communicate a device identifier configured to initiate Bluetooth pairing to an external computing device visually using a machine-readable optical identifier at a dynamic display device, or wirelessly using at least one radio configured for Near-Field Communications (NFC);

based at least on communicating the device identifier to the external computing device, establish a Bluetooth connection between the electronic lock and the external computing device using the one or more radios;

receive an access code from the external computing device;

compare the time-based access code with the received access code; and grant access to one or more lock features when the time-based access code matches the received access code.

17. The electronic lock of claim 16, wherein the one or more processors communicate the device identifier to the external computing device visually using the machine-readable optical identifier at the dynamic display device.

18. The electronic lock of claim 16, wherein the one or more processors communicate the device identifier to the external computing device using NFC.

19. The electronic lock of claim 16, wherein the one or more processors are also configured to receive the access code from the external computing device using the at least one radio configured for Bluetooth communications.

20. An electronic lock, comprising:

a dynamic display device;

one or more radios configured at least for Bluetooth communications; and one or more processors that are configured to:

execute a time-based cryptographic algorithm to compute a time-based access code;

communicate a device identifier configured to initiate Bluetooth pairing to an external computing device using the dynamic display device;

based at least on communicating the device identifier to the external computing device using the dynamic display device, establish a Bluetooth connection between the electronic lock and the external computing device using the one or more radios;

receive an access code from the external computing device using the Bluetooth connection;

compare the time-based access code with the received access code; and grant access to one or more lock features when the time-based access code matches the received access code.

* * * * *